United States Patent [19]

Adin et al.

[11] 4,426,441

[45] Jan. 17, 1984

[54] DYE-FORMING DEVELOPERS IN AN IMAGING MATERIAL AND PROCESS

[75] Inventors: Anthony Adin; Roy C. DeSelms, both of Rochester, N.Y.

[73] Assignee: Eastman Kodak Company, Rochester, N.Y.

[21] Appl. No.: 446,737

[22] Filed: Dec. 3, 1982

[51] Int. Cl.[3] ..... G03C 5/24; G03C 1/40

[52] U.S. Cl. ..... 430/351; 430/364; 430/376; 430/377; 430/467; 430/470; 430/471; 430/472; 430/484; 430/543; 430/553; 430/566; 430/619; 430/620; 428/913

[58] Field of Search ..... 430/351, 364, 376, 377, 430/467, 470, 471, 472, 484, 543, 553, 566, 619, 620; 428/913

[56] References Cited

U.S. PATENT DOCUMENTS

| | | | |
|---|---|---|---|
| 3,138,571 | 6/1964 | Popoff | 260/45.9 |
| 3,457,075 | 7/1969 | Morgan et al. | 96/67 |
| 3,484,484 | 12/1969 | Schwartz et al. | 260/553 |
| 3,531,286 | 9/1970 | Renfrew | 96/67 |
| 3,615,503 | 10/1971 | Edens et al. | 430/467 |
| 3,761,270 | 9/1973 | de Mauriac et al. | 96/77 |
| 3,764,328 | 10/1973 | Birkeland | 96/67 |
| 3,887,376 | 6/1975 | Wilson et al. | 430/467 |

FOREIGN PATENT DOCUMENTS 2018453A 10/1979 United Kingdom .

OTHER PUBLICATIONS

Bent et al., Journal American Chemical Society, vol. 73, pp. 3100–3125, 1951.

*Research Disclosure,* Dec., 1978; Item No. 17643.

*Research Disclosure,* Jun., 1978, Item No. 17029.

*Research Disclosure,* Dec., 1977. Item No. 16479.

*Primary Examiner*—J. Travis Brown

*Attorney, Agent, or Firm*—Richard E. Knapp

[57] ABSTRACT

In a dye-forming imaging material comprising (a) a dye-forming coupler, and (b) an organic reducing agent that is capable in its oxidized form of reacting with the dye-forming coupler to form a dye, improvements are provided by a reducing agent that is a ureidoaniline silver halide developing agent free of strong electron withdrawing groups. Such an imaging material can be a photographic silver halide material. The imaging material can be a photothermographic material for producing a dye image comprising, in reactive association, (a) photographic silver halide, (b) a dye-forming coupler, and (c) an oxidation-reduction image forming combination comprising (1) an organic silver salt oxidizing agent, and (2) an organic reducing agent for the organic silver salt oxidizing agent, wherein the reducing agent is a ureidoaniline which is capable in its oxidized form of reacting with the dye-forming coupler to form a dye. A thermographic material comprises the same combination of components without the need for photographic silver halide. A silver image and dye image are produced in such an exposed photothermographic material by heating the material until the silver image and dye image are produced. An image in a thermographic material is produced by imagewise heating the material. Ureidoaniline silver halide developing agents are also useful in processing compositions for photographic silver halide materials.

58 Claims, No Drawings

DYE-FORMING DEVELOPERS IN AN IMAGING MATERIAL AND PROCESS

BACKGROUND OF THE INVENTION

1. Field of the Invention

This invention relates to a dye-forming material and process for producing a dye image by means of a dye-forming coupler and a ureidoaniline developing agent that is capable in its oxidized form of reacting with the dye-forming coupler. It also relates to a photothermographic material and a thermographic material and process for producing a dye image by means of such a coupler and developing agent.

2. Description of the State of the Art

Dye-forming imaging materials and processes are known for producing dye images by means of a dye-forming coupler and a reducing agent that is capable in its oxidized form of reacting with the dye-forming coupler. Such materials and processes are described in, for example, *Research Disclosure,* December 1978, Item No. 17643.

Silver halide photothermographic materials and processes for producing silver images and dye images are also known. Examples of such materials and processes are described in, for instance, U.S. Pat. Nos. 3,531,286 and 3,761,270. Such photothermographic materials comprise, in reactive association, (a) photographic silver halide, (b) a dye-forming coupler and (c) an oxidation-reduction image forming combination comprising (1) an organic silver salt oxidizing agent and (2) an organic reducing agent for the organic silver salt oxidizing agent wherein the organic reducing agent in its oxidized form reacts with the dye-forming coupler.

Phenylenediamine silver halide developing agents have been included in such imaging materials as the organic reducing agent. One problem encountered with these developing agents is that they do not enable a sufficiently wide optimum pH latitude for coating such imaging materials, especially such photothermographic materials and for dye formation. Another problem centers on the desire to replace the phenylenediamine developing agents with milder reducing agents in such photothermographic materials. No answer to these problems is found in the photographic art.

It has been desirable to replace the p-phenylenediamine silver halide developing agents in such imaging materials and processes with a milder developing agent that enables efficient, dye formation without such disadvantages and tendency to produce higher minimum density values than desired and that enables a water optimum pH range for coating and for dye formation.

SUMMARY OF THE INVENTION

It has been found that these problems are answered by a dye-forming imaging material, preferably a photographic silver halide material, comprising (a) a dye-forming coupler, and (b) an organic reducing agent that is capable in its oxidized form of reacting with the dye-forming coupler to form a dye, wherein the reducing agent is a ureidoaniline silver halide developing agent free of strong electron withdrawing groups. Preferably, the dye-forming imaging material is a silver halide photothermographic material comprising, in reactive association;

(a) photographic silver halide, (b) a dye-forming coupler, and (c) an oxidation-reduction image forming combination comprising (1) an organic silver salt oxidizing agent, such as an organic silver salt oxidizing agent comprising a silver salt of a long chain fatty acid, and (2) an organic reducing agent for said organic silver salt oxidizing agent, wherein the reducing agent is a ureidoaniline reducing agent that is capable in its oxidized form of reacting with the dye-forming coupler. During processing the ureidoaniline reducing agent in its oxidized form reacts with the dye-forming coupler to form a dye. A silver image is also formed in the exposed photographic material upon processing.

This is illustrated by the following equations:

$$\text{Coupler} + \underset{\text{Developing Agent}}{\text{Ureidoaniline}} + \underset{\text{(exposed)}}{\text{AgX}} \longrightarrow \text{Ag}^{\circ} + \text{Coupler} + \text{HX} + \text{Oxidized Ureidoaniline}$$

$$\underset{\text{Ureidoaniline}}{\text{Oxidized}} + \text{Coupler} \longrightarrow \text{Dye}$$

A further reaction that is believed to take place in a photothermographic material in the exposed areas during processing is illustrated by the following equation:

$$\underset{\text{Oxidizing Agent}}{\text{Organic Silver Salt}} + \underset{\text{Developing Agent}}{\text{Ureidoaniline}} \xrightarrow{\text{processing temperature}} \text{Ag}^{\circ} + \underset{\text{ureidoaniline}}{\text{oxidized}} + \underset{\text{silver salt}}{\text{reduced organic}}$$

The ureidoaniline reducing agents are milder reducing agents than p-phenylenediamines. They enable a wider pH latitude for coating of a photographic material and for dye formation than p-phenylenediamines.

The terminology "free of strong electron withdrawing groups" herein means that the described ureidoaniline silver halide developing agent contains no substituent group which has sufficiently high electron withdrawing properties to prevent or adversely affect the ureidoaniline silver halide developing from producing a dye upon processing. An example of a strong electron withdrawing group which is to be avoided is $$-\overset{\overset{\displaystyle O}{\|}}{C}-CCl_3,$$

as illustrated in following comparative Example A.

A process of producing a dye image in an exposed photothermographic element according to the invention comprises heating the element to a temperature within the range of about 90° C. to about 200° C., preferably about 100° C. to about 150° C., until the dye image is produced. A silver image is also produced during heating. The dye image preferably enhances the silver image.

A thermographic material according to the invention comprises the same components as a photothermographic material without the need for photographic silver halide. A process of producing an image in a thermographic element according to the invention comprises imagewise heating the element to a temperature within the range of about 90° to about 200° C. until the image is produced.

DETAILED DESCRIPTION OF THE INVENTION

A variety of ureidoaniline silver halide developing agents are useful in an imaging element, such as a photothermographic element, a thermographic material or a dye-forming processing solution. Combinations of ureidoaniline developing agents and other silver halide developing agents are useful. Examples of ureidoaniline reducing agents are represented by the formula:

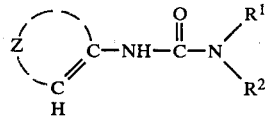

wherein

Z is the atoms, preferably atoms, selected from the group consisting of carbon, hydrogen, nitrogen and oxygen atoms to complete an aniline silver halide developing agent;

$R^1$ is alkyl containing 1 to 25 carbon atoms, such as methyl, ethyl, propyl, butyl, decyl, eicosyl, pentacosyl; benzyl, and $$-R^4-\overset{O}{\overset{\|}{C}}-O-R^3;$$

aryl containing 6 to 25 carbon atoms, such as phenyl, methoxyphenyl, 3-hydroxy-5-methylphenyl, naphthyl, tolyl and xylyl; or with $R^2$ is the atoms selected from the group consisting of carbon, nitrogen and oxygen atoms necessary to complete a 5 or 6 member nonaromatic heterocyclic group, such as a pyrrlino, pyrrolidino, piperazino or piperidino group;

$R^2$ is hydrogen; alkyl containing 1 to 25 carbon atoms, such as methyl, ethyl, propyl, butyl, decyl, eicosyl and pentacosyl; aryl containing 6 to 25 carbon atoms, such as phenyl, naphthyl, tolyl and xylyl; or with $R^1$ is the atoms selected from the group consisting of carbon, nitrogen and oxygen atoms necessary to complete a 5 or 6 member nonaromatic heterocyclic group;

$R^3$ is alkyl containing 1 to 25 carbon atoms, such as methyl, ethyl, propyl, butyl, octyl, decyl, eicosyl and pentacosyl, or aryl containing 6 to 25 carbon atoms such as phenyl, naphthyl, tolyl and xylyl; and $R^4$ is alkylene containing 1 to 25 carbon atoms, such as methylene, ethylene and hexadecylene; or arylene containing 6 to 25 carbon atoms, such as phenylene, tolylene and xylene. The ureidoaniline silver halide developing agents according to the invention are capable, in oxidized form, of reaction with a coupler to form a dye. The substituent groups on the ureidoaniline silver halide developing agent should not interfere with the desired oxidative coupling reaction to form a desired dye.

The terms "alkyl" and "aryl" herein include unsubstituted alkyl, such as unsubstituted methyl, ethyl, propyl or butyl, and unsubstituted aryl, such as unsubstituted phenyl. The terms also include alkyl and aryl that are substituted by groups which do not adversely affect the desired properties of the photographic material, the ureidoaniline silver halide developing agent or the coupling reaction which forms a dye. Examples of useful substituted alkyl groups include alkyl substituted by alkoxy such as methoxy and ethoxy. Substituted alkyl also includes $$-R^4-\overset{O}{\overset{\|}{C}}-O-R^3$$

wherein $R^4$ and $R^3$ are as defined. Examples of useful substituted aryl groups include methoxyphenyl, 2,4,6-triisopropyl-phenyl and tolyl. Aryl herein includes alkaryl such as benzyl and xylyl.

A preferred ureidoaniline silver halide developing agent is represented by the formula:

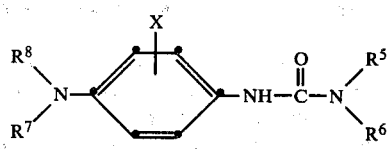

wherein $R^5$ is alkyl containing 1 to 25 carbon atoms, such as methyl, ethyl, propyl, butyl, decyl, eicosyl pentacosyl; and, $$-R^{10}-\overset{O}{\overset{\|}{C}}-O-R^9;$$

aryl containing 6 to 25 carbon atoms, such as phenyl and naphthyl; or with $R^6$ is the atoms selected from the group consisting of carbon, nitrogen and oxygen atoms necessary to complete a 5 or 6 member heterocyclic group, such as a pyrrlidino, piperazino or piperidino group;

$R^6$ is hydrogen, alkyl containing 1 to 25 carbon atoms, such as methyl, ethyl, propyl, butyl, decyl, eicosyl and pentacosyl; or aryl containing 6 to 25 carbon atoms, such as phenyl and naphthyl; or with $R^5$ is the atoms selected from the group consisting of carbon, nitrogen and oxygen atoms necessary to complete a 5 or 6 member heterocyclic group;

$R^7$ is alkyl containing 1 to 25 carbon atoms, such as methyl, ethyl, propyl, butyl, dodecyl, tricosyl and pentacosyl; or with $R^8$ is the atoms selected from the group consisting of carbon, nitrogen and oxygen atoms, necessary to complete a 5 or 6 member nonaromatic heterocyclic group, such as a pyrrolino, pyrrolidino, piperazino or piperidino group;

$R^8$ is alkyl containing 1 to 25 carbon atoms, such as methyl, ethyl, propyl, butyl, octyl, decyl, eicosyl and pentacosyl; or with $R^5$ is the atoms selected from the group consisting of carbon, nitrogen and oxygen atoms necessary to complete a 5 or 6 member nonaromatic heterocyclic group;

$R^9$ is alkyl containing 1 to 25 carbon atoms, such as methyl, ethyl, propyl, butyl, octyl, decyl, eicosyl, and pentacosyl; or aryl containing 6 to 25 carbon atoms, such as phenyl and naphthyl;

$R^{10}$ is alkylene containing 1 to 25 carbon atoms such as methylene and ethylene or arylene containing 6 to 25 carbon atoms, such as phenylene; and X is hydrogen, alkyl containing 1 to 3 carbon atoms, such as methyl, ethyl and propyl; alkoxy containing 1 to 3 carbon atoms, such as methoxy, ethoxy and propoxy; bromine; chlorine; or iodine.

The term "nonaromatic" heterocyclic group herein means that the heterocyclic group is not completely saturated. The term does not include such groups as pyrazino and pyrimidino groups. A nonaromatic heterocyclic group herein has no saturation in conjugation with a nitrogen atom.

An optimum ureidoaniline reducing agent according to the invention will depend upon such factors as the desired image, the particular photographic material, processing steps and conditions, particular coupler in the photographic material, other components in the photographic material or processing composition and the particular photographic silver halide in the photographic material. Examples of useful ureidoaniline silver halide developing agents include the following:

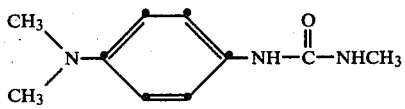
(1)

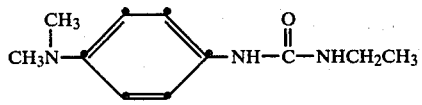
(2)

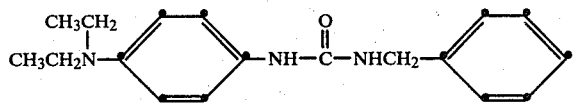
(3)

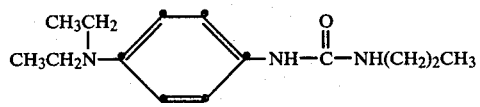
(4)

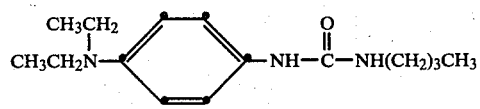
(5)

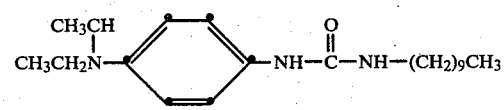
(6)

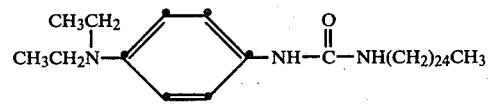
(7)

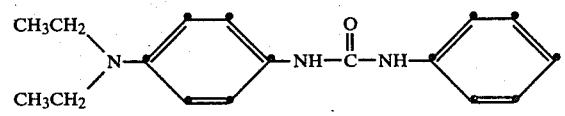
(8)

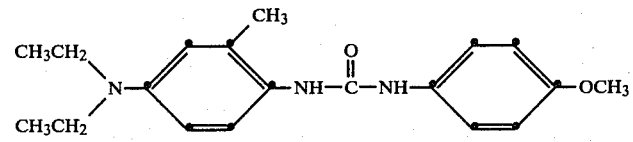
(9)

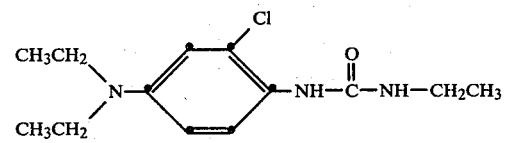
(10)

-continued
(11)
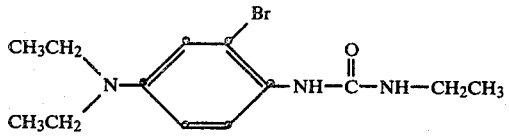
(12)
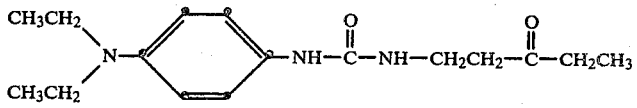
(13)
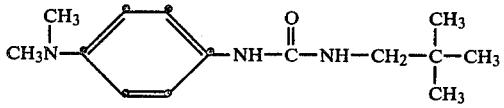
(14)
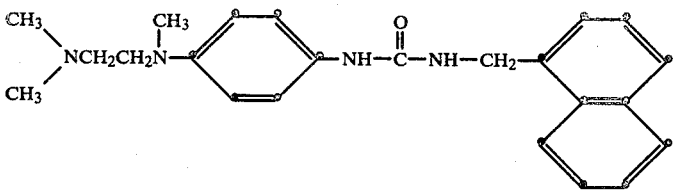
(15)
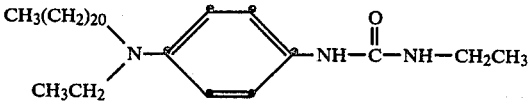
(16)
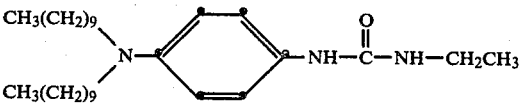
(17)
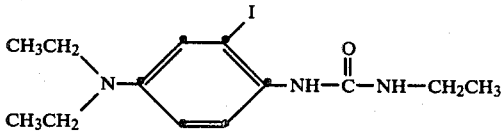
(18)
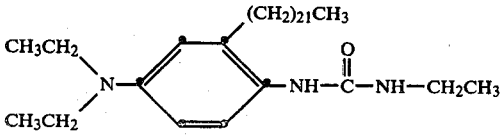
(19)
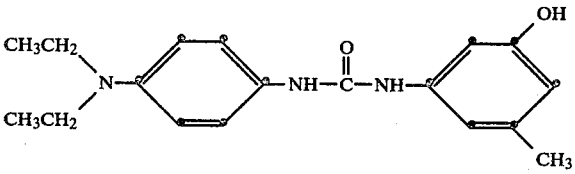
(20)
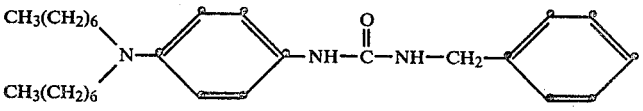
(21)
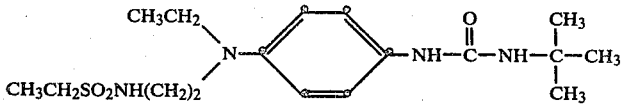

-continued
(22)
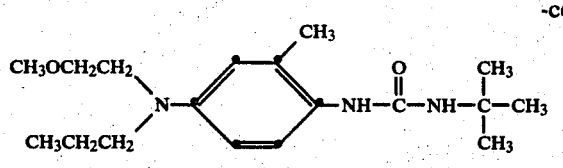
(23)
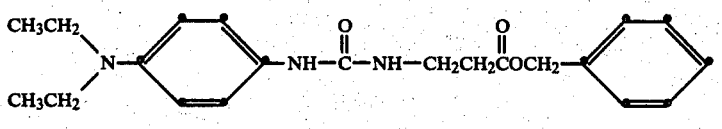
(24)
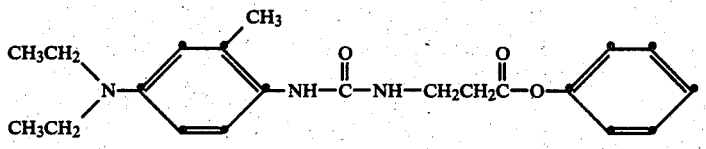
(25)
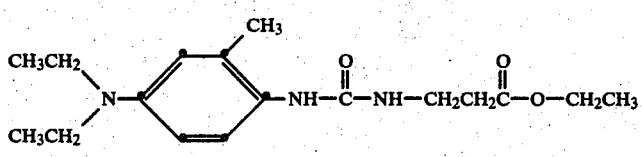
(26)
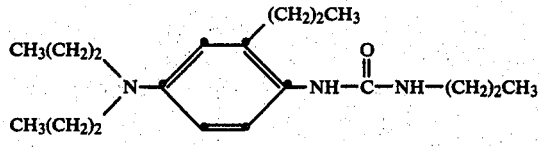
(27)
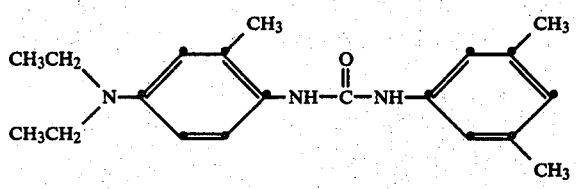
(28)
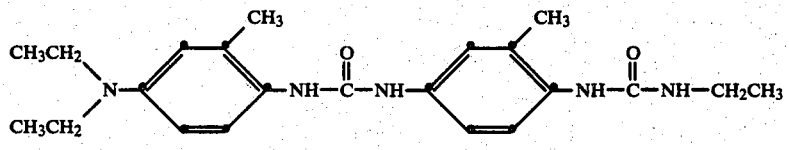
(29)
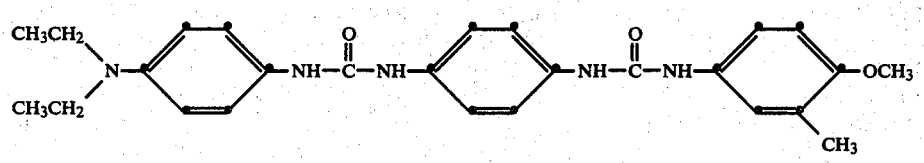
(30)
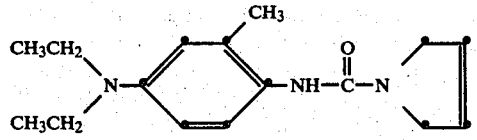
(31)
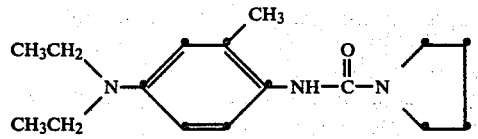
(32)
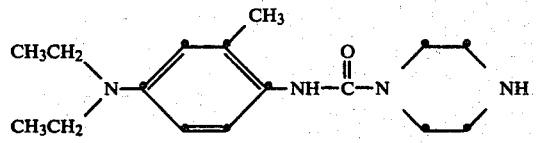

-continued

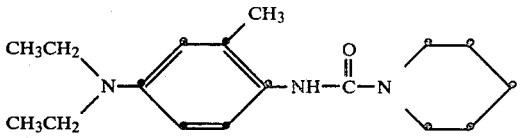

(33)

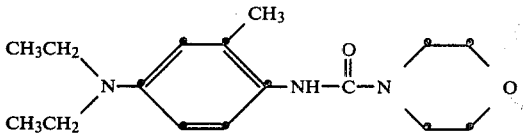

(34)

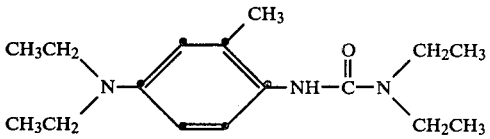

(35)

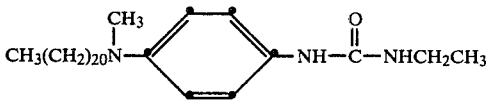

(36)

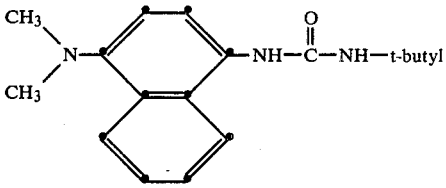

(37)

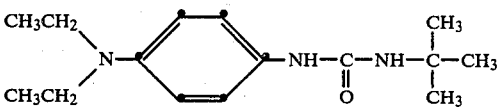

(38)

The ureidoaniline reducing agents according to the invention are prepared by general methods of synthesis known in the organic synthesis art. An illustrative method of synthesis is represented by the reaction:

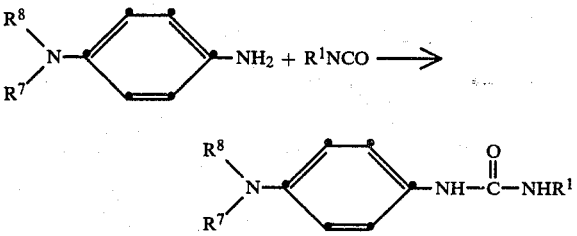

wherein $R^1$, $R^7$ and $R^8$ are as defined. Another method of synthesis is represented by the following reaction:

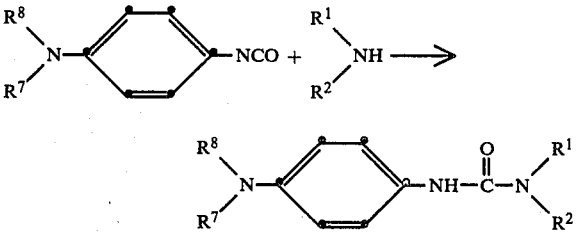

wherein $R^1$, $R^2$, $R^7$ and $R^8$ are as defined. These methods involve the reaction of an amine with an isocyanate compound. In these methods 0.1 mole of the appropriate amine is dissolved in 200 ml of a solvent such as 1,2-dimethoxyethane or ethanol. A catalyst, such as 3 drops of triethylamine, is preferably added and 0.1 mole of the isocyanate is added gradually. The temperature of the reaction is controlled at about 35° C. The reaction is generally complete within 1 to 24 hours as indicated by thin layer chromatographic techniques known in the organic synthesis art. If on completion of the reaction, the product does not precipitate, the solvent is removed at reduced pressure and the product is recrystallized. The ureidoaniline reducing agents prepared according to these methods are identified by elemental analysis or other analytical techniques known in the organic synthesis art.

Another method for preparation of ureidoanilines according to the invention is illustrated by the following reaction:

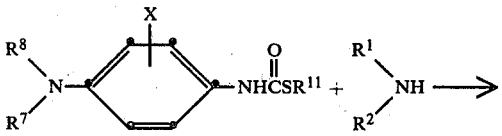

-continued

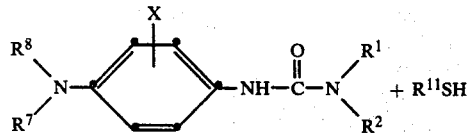

wherein $R^1$, $R^2$, $R^7$, $R^8$ and X are as defined and $R^7$ is a group that does not adversely affect the ureidoaniline compound, such as $CH_3$— or $C_2H_5$—.

This latter synthesis permits preparation of a ureidoaniline silver halide developing agent without the need for isocyanate intermediates. An illustrative preparation of this latter synthesis is as follows: a solution of 0.015 mole of a p-phenylenediamine thiocarbamate and 0.03 mole of the primary or secondary amine are heated in 80 ml of a solvent, preferably 1,2-dimethoxyethane, at reflux under a nitrogen atmosphere. The reaction is carried out until thin layer chromatography indicates reaction completion. The reaction is generally complete within about 48 hours. The product is generally purified by purification methods known in the organic synthesis art, such as recrystallization from a solvent, such as toluene. Mixtures are generally concentrated at reduced pressure and the excess amine is washed from the composition with water. The pure ureidoaniline is obtained by recrystallization or other purification techniques known in the organic synthesis art.

The thiocarbamate intermediate compound is also prepared by methods known in the organic synthesis art. An example of such a preparation is the preparation of 4-diethylamino-2-methoxyaniline ethylthiocarbamate: 300 ml of diethyl ether and 100 ml of saturated aqueous sodium bicarbonate are placed in a separatory funnel; then, 14.0 grams (0.05 mole) of diethylamino-2-methoxyaniline dihydrochloride is added and the mixture shaken and separated after effervescence subsides. The aqueous sodium bicarbonate is extracted once again with ether. The ether extracts are combined, dried over anhydrous potassium carbonate, filtered, cooled to 15° C., and treated with 5 grams (7 ml, 0.05 mole) of triethylamine; then gradually 6 grams (5 ml, 0.05 mole) of ethyl chlorothiolformate are added. The addition is gradual (over a period of 15 minutes) with stirring. The mixture is allowed to come to room temperature (about 20° C.), stirred for 20 hours, filtered and then concentrated at reduced pressure. The desired product has a melting point of 74°–75° C. A sample is recrystallized from ethanol-water to provide a purified product having a melting point of 76°–78° C. Other thiocarbamate compounds prepared by similar processes include 4-diethylaminoaniline ethylthiocarbamate (melting point of 89°–90° C.) and 4-dimethylaminoaniline ethylthiocarbamate (melting point 96°–97° C.).

Generally, the ureidoaniline reducing agents are colorless in a photographic material or photographic processing solution prior to processing. Some of the ureidoaniline reducing agents have a slight color in the photographic material or photographic processing solution. This slight color is not considered unacceptable.

The term "colorless" herein means that the ureidoaniline reducing agent does not absorb radiation to an undesired degree in the visible region of the electromagnetic spectrum. In some photographic materials the ureidoaniline absorbs radiation in certain areas of the electromagnetic spectrum which does not adversely affect the desired properties of the photographic material or the desired image formed upon processing.

The imaging materials according to the invention generally comprise a photographic component, preferably a photographic silver salt such as photographic silver halide. It is essential that the photographic component not adversely affect the ureidoaniline reducing agent or the imaging process. Examples of useful photographic silver halides are silver chloride, silver bromide, silver bromoiodide, silver chlorobromoiodide, silver iodide and mixtures thereof. The photographic silver halide is generally present in the photographic material in the form of an emulsion which is a dispersion of the photographic silver halide in a binder. The photographic silver halide is present in a range of grain sizes from fine-grain to coarse-grain. The composition containing the photographic silver halide is prepared by any of the well-known procedures in the photographic art, such as described in *Research Disclosure,* December 1978, Item No. 17643. The photographic silver halide material contains addenda commonly present in photographic silver halide materials. The photographic silver halide material optionally comprises, for example, chemical sensitizers, brighteners, antifoggants, emulsion stabilizers, light-absorbing or scattering materials, hardeners, coating aids, plasticizers, lubricants and antistatic materials, matting agents, development modifiers and other addenda described in *Research Disclosure,* December 1978, Item No. 17643, the disclosure of which is incorporated herein by reference. The silver halide can be, for example, a tabular grain silver halide. The photographic silver halide can also comprise silver halide to produce positive images.

Photographic materials according to the invention contain a range of concentrations of photographic silver halide. An optimum concentration of photographic silver halide will depend upon such factors as the desired image, processing conditions, particular ureidoaniline silver halide developing agent and other components in the photographic material. A preferred concentration of photographic silver halide in the photographic material is within the range of about 0.1 milligrams to about 10 milligrams of silver per square decimeter of support.

The photographic silver halide is generally spectrally sensitized by means of spectral sensitizing dyes, such as described in *Research Disclosure,* December 1978, Item No. 17643. Spectral sensitizing dyes which are useful in the photographic materials include polymethine sensitizing dyes which include the cyanines, merocyanines, complex cyanines and merocyanines (including tri-, tetra and polynuclear cyanines and merocyanines), as well as oxonols, hemioxonols, styryls, merostyryls and streptocyanines. Combinations of spectral sensitizing dyes are useful.

the photographic silver halide in a photothermographic material according to the invention is optionally prepared in situ. The photothermographic material, for example, can contain photographic silver halide that is prepared in or on one or more of the other components of the photothermographic material rather than prepared separate from the described components and then admixed with them. Such a method of preparing silver halide in situ is described in, for example, U.S. Pat. No. 3,457,075, the description of which is incorporated herein by reference.

The ureidoaniline reducing agent according to the invention is in any location in the imaging material which produces the desired image. The ureidoaniline reducing agent is in a location with respect to the photographic silver halide that produces a silver image upon processing. If desired, the ureidoaniline reducing agent is in a layer contiguous to the layer of the photographic element comprising photographic silver halide. The term "in reactive association" herein means that the photographic silver halide and the ureidoaniline reducing agent are in a location with respect to each other which enables the photographic material upon processing to produce a desired image.

Many silver halide developing agents are useful in combination with the ureidoaniline reducing agents for developing an image in a photographic material. Silver halide developing agents with which the ureidoaniline reducing agents are useful are described in, for example, *Research Disclosure,* December 1978, Item No. 17643 and *Research Disclosure,* June 1978, Item No. 17029. Examples of such developing agents include, for instance, 3-pyrazolidones, such as 1-phenyl-3-pyrazolidone, 4-hydroxymethyl-4-methyl-1-phenyl-3-pyrazolidone; sulfonamidophenols, such as 2,6-dichloro-4-benzenesulfonamidophenol and 2,6-dibromo-4-benzenesulfonamidophenol; ascorbic acid developing agents such as ascorbic acid and ascorbic acid ketals; aminophenol developing agents, such as 2,6-dichloro-4-aminophenol.

The silver halide developing agent or silver halide developing agent combination is useful in a range of concentrations in the photographic material. A preferred concentration of developing agent or developing agent combination is within the range of about 0.1 to about 10.0 moles of developing agent or developing agent combination per mole of photographic silver halide in the photographic material.

The term "developing agent" herein includes compounds which are developing agents and developing agent precursors. That is, those compounds are included which are not developing agents in the photographic material until a condition occurs, such as heating or contact with an activator for the photographic material.

The tone of the image, such as the silver image and the image dye, varies depending upon such factors as the silver morphology of the developed silver image, covering power of the silver materials, the particular dye formed, the particular ureidoaniline reducing agent, processing conditions, concentration of components and other materials present in the photographic material during imaging. In photothermographic materials that provide a brown image, an image dye that is especially useful is one that is complementary in hue to the brown-silver image.

The photographic materials according to the invention preferably comprise a binder. Binders are useful alone or in combination in a photographic material according to the invention. Useful binders in the photographic material include both naturally-occurring substances such as proteins, for example, gelatin, gelatin derivatives, cellulose derivatives, polysaccharides such as dextran, gum arabic and the like, and synthetic materials which are compatible with the ureidoaniline reducing agent and other components in the photographic material. Hydrophobic binders are useful in the photothermographic materials. Such binders include polymers of alkylacrylates and methacrylates, acrylic acid, sulfoalkylacrylates or methacrylates and those which have cross-linking sites that facilitate hardening or curing. Other useful hydrophobic binders include high molecular weight materials and resins such as poly(vinyl butyral), cellulose acetate butyrate, poly(methyl methacrylate), polystyrene, poly(vinyl chloride), chlorinated rubber, poly(isobutylene), butadiene-styrene copolymers, vinyl chloride-vinyl acetate copolymers, copolymers of vinyl acetate, vinyl chloride and maleic anhydride and the like. It is important that the binder, especially the hydrophobic binder, not adversely affect the sensitometric properties of the photographic material. Poly(vinyl butyral) is a preferred binder in photothermographic silver halide materials. This is available under the trademark "Butvar" from the Monsanto Company, U.S.A.

The photographic elements according to the invention optionally comprise an overcoat layer and/or interlayer and/or subbing layer to provide desired properties. The overcoat layer, for example, increases resistance to abrasion and other markings on the photographic element. The overcoat layer, interlayer or subbing layer contain, alone or in combination, vehicles and binders that are useful in the layer of the element containing the photographic silver halide.

An imaging element according to the invention comprises a variety of supports. Useful supports include those which are resistant to adverse changes in structure due to processing conditions and which do not adversely affect the desired sensitometric properties of the photographic materials. Useful supports include, for example, poly(vinyl acetal), poly(ethylene terephthalate) and polycarbonate films, as well as related films and resinous materials. Glass, paper, metal and the like supports are also useful. A flexible support is generally most useful.

The photographic materials according to the invention are coated on a support by procedures known in the photographic art. Such procedures include, for example, immersion or dip coating, roller coating, reverse roll coating, air-knife coating, doctor-blade coating, spray coating, extrusion coating, dip coating, stretch-flow coating and curtain coating.

The photographic materials are generally imagewise exposed by means of various forms of energy to produce a developable image. Such forms of energy include those to which the photographic material is sensitive. These forms of energy include the ultraviolet, visible and infrared regions of the electromagnetic spectrum, as well as electron beam and beta radiation, gamma ray, x-ray, alpha particle, neutron radiation and other forms of radiant energy in either non-coherent (random phase) forms or coherent (in phase) forms as produced by lasers. Exposures are monochromatic, orthochromatic or panchromatic depending upon the spectral sensitization of the photographic silver halide. Imagewise exposure is generally for a sufficient time and intensity to produce a developable image in the photographic material.

The photothermographic materials are processed after exposure in a single step or multistep process to produce a silver image and dye image. In a single step process the photothermographic element after exposure is heated to processing temperature to produce a silver image and a dye image. In a multistep process the initial heating step is sufficient to enable development of the exposed photographic silver halide. Subsequent steps are then at optionally higher temperatures to enable dye formation and optionally to transfer dye to an image receiver. Processing temperatures are within the range of about 90° C. to about 200° C. Preferably, the process is carried out at a processing temperature which does not adversely affect the support of the photothermographic element. The processing temperature is preferably within the range of about 100° C. to about 150° C.

Heating is carried out during processing until a desired image is produced, generally within about 2 to about 90 seconds. Selection of an optimum processing time and temperature for each processing step will depend upon such factors as the desired image and particular components of the photographic material.

A variety of heating means are useful to heat the photothermographic material to develop the desired image. The heating means is, for example, a hot plate, iron, roller, heated drum, infrared heating means, hot air heating means and the like.

Processing is preferably carried out under ambient conditions of pressure and humidity. Pressures and humidity outside normal atmospheric conditions are also useful.

A variety of organic heavy metal salt oxidizing agents, preferably organic silver salt oxidizing agents, are useful in a photothermographic material according to the invention. Examples of useful organic silver salt oxidizing agents are described in, for example, *Research Disclosure,* June 1978, Item No. 17029, the description of which is incorporated herein by reference. Examples of useful organic silver salt oxidizing agents include silver behenate, silver stearate, silver palmitate and silver salts of other compounds such as silver salts of 1,2,4-mercaptotriazole derivatives, such as described in *Research Disclosure,* June 1977, Item No. 15869. Another class of useful organic silver salt oxidizing agent is represented by complexes or salts of silver with a nitrogen acid, such as a nitrogen acid selected from the group consisting of imidazole, pyrazole, urazole, 1,2,4-triazole and 1H-tetrazole nitrogen acids or combinations of these acids. The silver salts or complexes of nitrogen heterocyclic acids are described in, for example, *Research Disclosure,* October 1976, Item No. 15026. Selection of an optimum organic silver salt or complex oxidizing agent, or combination of such oxidizing agents, will depend upon such factors as the desired image, particular silver halide, processing temperature and other conditions, particular ureidoaniline reducing agent and other addenda in the photothermographic material.

The terms "salt" and "complex" herein include any type of bonding or complexing mechanism which enables the resulting material to provide desired imaging properties in the photographic materials according to the invention. In some instances, the exact bonding of the described organic silver salt or complex is not fully understood. The terms "salt" and "complex" are intended to include neutral complexes and non-neutral complexes.

A stabilizer or stabilizer precursor is optionally present in the photothermographic material to provide improved post-processing image stability. It is desirable in most instances to stabilize the silver halide after processing to help reduce post-processing printup. A variety of stabilizers and stabilizer precursors are useful in the photothermographic materials. The stabilizers and stabilizer precursors are useful alone or in combination. Optional stabilizers and stabilizer precursors are sulfur compounds that form a stable silver mercaptide after image development with the photographic silver material at processing temperatures. Photolytically active halogenated organic compounds are also optionally useful in the photothermographic materials according to the invention. Such stabilizers and stabilizer precursors are described in, for example, *Research Disclosure,* June 1978, Item No. 17029, the description of which is incorporated herein by reference. Selection of an optimum stabilizer or stabilizer precursor or combination thereof will depend upon such factors as the particular photographic silver halide, processing conditions, desired image, particular ureidoaniline reducing agent, and other components in the photothermographic material.

The photothermographic material according to the invention generally comprises an image toner to produce a more neutral appearing or black tone image upon processing. Combinations of image toners are also useful. The optimum toning agent or toning agent combination will depend upon such factors as the particular photographic silver halide, the desired image, particular processing conditions, particular ureidoaniline reducing agent and other components in the photothermographic material. Useful toning agents are selected from those described in, for example, *Research Disclosure,* June 1978, Item No. 17029, the description of which is incorporated herein by reference. Preferred toning agents are phthalazinone, phthalimide, N-hydroxynaphthalimide, phthalazine, and succinimide and combinations of such toning agents.

A toning agent or toning agent combination is useful in a range of concentrations in a photothermographic material according to the invention. The optimum concentration of toning agent or toning agent combination will depend upon the described factors such as the particular photographic silver halide, processing conditions, desired image, particular ureidoaniline reducing agent and other components in the photothermographic material. A preferred concentration of toning agent or toning agent combination is within the range of about 0.01 to about 1.0 mole of toning agent per mole of organic silver salt oxidizing agent in the photothermographic material.

The photothermographic material can contain a melt-forming compound to aid in processing. The melt-forming compound generally provides an improved developed image. The term "melt-forming compound" herein means a compound which upon heating to the described processing temperature produces an improved reaction medium, generally a melt medium, within which the image-forming combination and photographic component produce better image development. The exact nature of the reaction medium in the photothermographic material at processing temperatures is not fully understood. It is believed at the reaction temperatures a melt occurs which permits the reaction components to better interact and to fuse into contiguous layers of the photothermographic element. Useful melt-forming compounds are generally components separate from the image-forming combination, although the image-forming combination and other addenda in the photothermographic material generally enter into the melt formation. Preferred melt-forming compounds are amides, imides, cyclic ureas and triazoles which are compatible with other components of the photothermographic materials and do not adversely affect dye formation. Useful melt-forming compounds are generally selected from those described in, for example, U.S. Pat. No. 3,438,776. Examples of useful melt-forming compounds include 1,3-dimethylurea, N-propylurea, 2-pyrrolidone and formamide. Combinations of melt-forming compounds are also useful.

The melt-forming compound or combination of melt-forming compounds is useful in a range of concentrations in the photothermographic materials according to the invention. Preferred concentrations of melt-forming compounds are within the range of about 0.5 to about 2 parts by weight of melt-forming compound per gram of organic silver salt oxidizing agent in the photothermographic material. The optimum concentration of the melt-forming compound or combination of melt-forming compounds will depend upon the described factors.

A photographic material and/or a photographic processing solution according to the invention comprises a dye-forming coupler. Useful dye-forming couplers form dyes that absorb in the visible, ultraviolet or infrared regions of the electromagnetic spectrum. Such dye-forming couplers are described in, for example, *Research Disclosure,* December 1978, Item No. 17643 and *Research Disclosure,* June 1978, Item No. 17029, the description of which is incorporated herein by reference. The dye-forming coupler optionally has a coupling off group in the coupling position of the coupler if desired. This coupling off group is, for example, chloro, phenoxy and phenylmercaptotetrazole. Preferred dye-forming couplers are two-equivalent couplers or four-equivalent couplers. The term "four-equivalent coupler" herein means a dye-forming coupler that requires 4 moles of silver for each mole of dye formed in the photographic material according to the invention. The term "two-equivalent coupler" herein means a dye-forming coupler that requires 2 moles of silver for each mole of dye formed in the photographic material according to the invention. A preferred dye-forming four-equivalent coupler includes a resorcinol coupler as described in, for example, U.S. Pat. No. 4,126,461. Examples of useful resorcinol dye-forming couplers are 2-acetamido resorcinol and 2-trifluoroacetamido resorcinol. Other useful dye-forming four-equivalent couplers include diacylaminophenol couplers described in U.S. Pat. No. 2,772,162; couplers containing fluoroalkylcarbonamido groups described in U.S. Pat. No. 2,895,826; 1-naphthyl-2-carboxylic acid amide couplers described in U.S. Pat. No. 2,474,293; 1-hydroxynaphthamide couplers described in U.S. Pat. No. 3,002,836; acylated amino pyrazolone couplers described in U.S. Pat. No. 2,369,489; halogen substituted 1-phenyl-3-acylamino-5-pyrazolone couplers described in U.S. Pat. No. 2,600,788; couplers containing a phenoxyacylamino group as described in U.S. Pat. No. 2,908,573; acetoacetanilide couplers as described in U.S. Pat. No. 3,265,506; benzoylacetanilide couplers as described in U.S. Pat. No. 2,875,057; and, phenolic dye-forming couplers containing a ureido group as described in European Pat. No. 0028099, the disclosures of which are incorporated herein by reference. Useful dye-forming two-equivalent couplers are listed in, for example, *Research Disclosure,* December 1978, Item No. 17643, paragraph VII; and *Research Disclosure,* November 1979, Item No. 18716.

The dye-forming coupler is preferably incorporated in the photographic element. However, the dye-forming coupler is optionally in a processing solution for processing a photographic element according to the invention.

In preparing a photographic material comprising a ureidoaniline reducing agent, a dispersion solvent is optionally present to produce a coating composition. A coupler solvent known in the photographic art is optionally present for aiding dispersion of the dye-forming coupler and/or the ureidoaniline reducing agent. Examples of optional coupler solvents include N-n-butylacetanilide, diethyl lauramide, di-n-butyl phthalate and 2,4-ditertiary amylphenol. The ureidoaniline reducing agent and the dye-forming coupler are optionally loaded into a latex, or a non-solvent dispersion is prepared if desired.

The dye-forming coupler is useful in a range of concentrations in the photographic materials. Preferred concentrations of dye-forming coupler are within the range of about 0.1 to about 10 moles per mole of ureidoaniline in the photographic material. The optimum concentration of dye-forming coupler or combination of dye-forming couplers in the photographic materials will depend upon the described factors.

The dye-forming coupler or combination of dye-forming couplers are useful in a range concentration in a processing solution according to the invention. Preferred concentrations of dye-forming coupler or combinations of dye-forming couplers in a processing solution are within the range of about 0.1 to about 10 moles per mole of ureidoaniline in the photographic processing solution. The optimum concentration of dye-forming coupler or combination of dye-forming couplers in a processing solution will depend upon the described factors.

A preferred dye-forming coupler in the dye-forming imaging element comprises a compound represented by the formula:

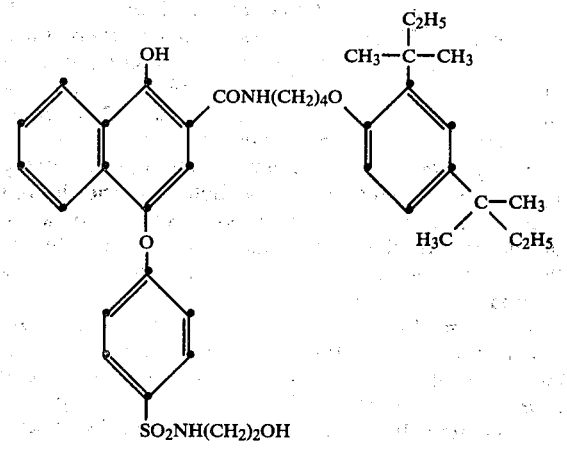

An optional embodiment of the invention comprises a dye-forming imaging composition comprising (a) a dye-forming coupler, and (b) an organic reducing agent that is capable in its oxidized form of reacting with the dye-forming coupler to form a dye, wherein the reducing agent is a ureidoaniline silver halide developing agent. Such a dye-forming imaging composition is useful in, for example, a layer of an imaging element contiguous to a layer containing photographic silver halide.

A preferred example of such a dye-forming imaging composition comprises a ureidoaniline silver halide developing agent consisting essentially of 1-(p-diethylaminophenyl)-3-t-butylurea and a dye-forming coupler consisting essentially of a compound represented by the formula:

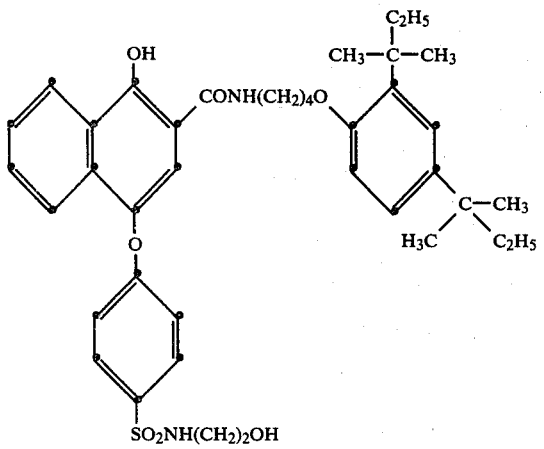

Another embodiment of the invention is a thermographic material comprising, in reactive association, in binder, (a) a dye-forming coupler, and (b) an oxidation-reduction image-forming combination comprising (1) an organic silver salt oxidizing agent, and (2) an organic reducing agent for the organic silver salt oxidizing agent, wherein the reducing agent is a ureidoaniline reducing agent that is capable in its oxidized form of reacting with the dye-forming coupler to form a dye. Such a thermographic material generally comprises a toning agent, such as described, including for example, a toning agent selected from the group consisting of phthalazinone, phthalimide, N-hydroxynaphthalimide, phthalazine and succinimide toning agents and combinations thereof.

A preferred thermographic material according to the invention comprises, in reactive association, in a poly(vinyl butyral) binder, (a) an oxidation-reduction image-forming combination comprising (1) an organic silver salt oxidizing agent comprising silver behenate, and (2) an organic reducing agent for the organic silver salt oxidizing agent comprising a ureidoaniline reducing agent that consists essentially of 1-(p-diethylaminophenyl)-3-t-butylurea; and, (b) a dye-forming coupler.

An image is produced in the thermographic material by imagewise heating the thermographic material to a temperature within the range of about 90° C. to about 200° C. until an image is produced.

A further embodiment of the invention is a dye-forming processing solution for a photographic silver halide element wherein the solution comprises (a) a dye-forming coupler, (b) a ureidoaniline silver halide developing agent that is capable in its oxidized form of reacting with the dye-forming coupler to form a dye, (c) an alkaline activator, and (d) at least one solvent for the processing solution.

A variety of solvents are useful for the dye-forming processing solution according to the invention. Examples of useful solvents include water and methanol. Selection of an optimum solvent for the dye-forming processing solution will depend upon the described factors.

A variety of alkaline activators are useful in the dye-forming processing solution. Alkaline activators that are useful are selected from those known in the photographic art for processing solution activation. Examples of useful alkaline activators include NaOH, $Na_3PO_4$, $Na_2CO_3$ and $K_2CO_3$. Selection of an optimum alkaline activator will depend upon the described factors.

A preferred photographic processing solution according to the invention comprises (a) 1-(p-diethylaminophenyl)-3-hydroxyethylurea as the ureidoaniline silver halide developing agent, (b) an activator, such as potassium carbonate and (c) a solvent, such as water. The processing solution preferably has a pH of at least 10, such as about 10 to about 14.

Another embodiment of the invention is a method of forming a dye image in an exposed photographic element comprising a support bearing, in reactive association, (a) photographic silver halide, and (b) a dye-forming coupler, comprising developing the exposed photographic element in a silver halide developer solution, wherein the developer solution comprises an alkaline activator and a ureidoaniline silver halide developing agent which reacts in its oxidized form with the dye-forming coupler to form a dye. This method of forming a dye image also can comprise bleaching and fixing the resulting image. Optimum conditions, such as temperature and time of processing, will depend upon the described factors, such as the desired image, particular dye-forming coupler, particular ureidoaniline silver halide developing agent and siver halide emulsion.

The following examples are included for a further understanding of the invention.

EXAMPLES 1–14

This illustrates use of ureidoaniline silver halide developing agents with a resorcinolic coupler in a photographic material.

A photographic element was prepared as follows:

A composition was prepared by adding the following to 0.3 g of tetrahydrofuran (solvent):

| | |
|---|---|
| 1(H)—phthalazinone (toner) | 2.0 mg |
| mercuric chloride (antifoggant) | 0.25 mg |
| surfactant (Pluronic L121 which is a block copolymer of ethylene oxide and propylene oxide and is a trademark of BASF Wyandotte, U.S.A.). | 6.0 mg |

To this composition was added 0.05 mmole of ureidoaniline developing agent (listed in following Table IA) and 0.05 mmole of the resorcinolic coupler:

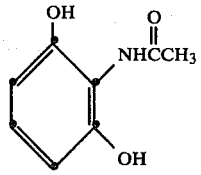

Then, the following were added to the resulting composition:

| | |
|---|---|
| poly(vinylbutyral) (binder) ("Butvar B76" which is a trademark of and available from the Monsanto Co., U.S.A.) (5.0% by weight in toluene) | 0.5 g |

-continued

| | |
|---|---|
| silver behenate dispersion (comprising: | 0.6 g |
| acetone | 406.9 g |
| toluene | 438.3 g |
| poly(vinylbutyral) | 55.0 g |
| alumina | 8.0 g |
| behenic acid | 31.2 g |
| lithium stearate | 5.9 g |
| silver behenate | 50.0 g) |
| AgBrI emulsion (0.01 - grains) by mixing: | 0.2 g |
| acetone, poly(vinylbutyral) lithium iodide, anhydrous, lithium bromide anhydrous, silver trifluoroacetate, to produce an emulsion comprising 15.7% solids and 40 g Ag/liter of solution) | |

The resulting photothermographic composition was coated at a total silver coverage of 0.9 g/M$^2$ on a poly(ethyleneterephthalate) film support containing a subbing layer to produce a photothermographic element. This photothermographic element was imagewise exposed to light in a commercial sensitometer for $10^{-3}$ seconds through a 0.3 log E step tablet to produce a developable latent image in the photothermographic element. The latent image was developed by uniformly heating the photothermographic element for ten seconds at 125° C. The heating was carried out by placing the side of the element opposite the exposed photothermographic layer on a vapor-heated processing drum. A dye image and silver image were produced in each photothermographic element containing a ureidoaniline as listed in following Table IA.

TABLE IA

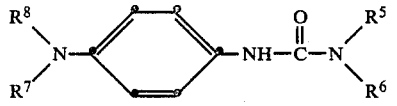

(Ureidoaniline)

| Example No. | $R^5$ | $R^6$ | $R^7$ and $R^8$ | $D_{max}$ (to red light) (dye image only) |
|---|---|---|---|---|
| 1 | H | HO 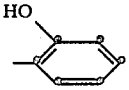 | $-CH_3$ | 0.16 |
| 2 | $-C(CH_2OH)_2-CH_3$ | H | $-CH_3$ | 0.55 |
| 3 | $-C(CH_2OH)_2-CH_2OH$ | H | $-CH_3$ | 0.40 |
| 4 | $HOCH_2$ 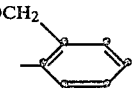 | H | $-CH_3$ | 0.30 |
| 5 | $-CH_2CH_2OH$ | $-CH_2CH_2OH$ | $-CH_3$ | 0.55 |
| 6 | $-C(=O)-CH_3$ | H | $-CH_3$ | 0.25 |

TABLE IA-continued

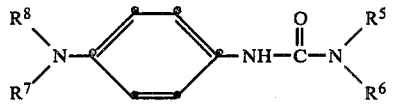

(Ureidoaniline)

| Example No. | $R^5$ | $R^6$ | $R^7$ and $R^8$ | $D_{max}$ (to red light) (dye image only) |
|---|---|---|---|---|
| 7 | $-C(CH_2OH)(CH_3)-CH_3$ | H | $-C_2H_5$ | 0.24 |
| 8 | $-C(CH_2OH)(CH_3)-CH_2OH$ | H | $-C_2H_5$ | 0.29 |
| 9 | $-C(CH_2OH)-CH_2OH-CH_2OH$ | H | $-C_2H_5$ | 0.28 |
| 10 | $-CH_2CH_2OH$ | $-CH_2CH_2OH$ | $-C_2H_5$ | 0.46 |
| 11 | $-CH_2CH(OH)CH_2CH_2CH_2-$ (completes heterocyclic ring) | | $-C_2H_5$ | 0.69 |
| 12 | $-CH_2CH_2CH_2CH_2CH_2-$ (completes heterocyclic ring) | | $-C_2H_5$ | 0.72 |
| 13 | $-CH(CH_3)-CH_2CH_2CH_2-CH(CH_3)-$ (completes heterocyclic ring) | | $-C_2H_5$ | 1.58 |
| 14 | $-CH(CH_3)_2$ | $-CH(CH_3)_2$ | $-C_2H_5$ | 1.79 |

The dye images were tested for Examples 10, 13 and 14 for stability in the dark. This test consisted of storing processed samples in a dark drawer under ambient conditions for the specified time and then re-measuring dye densities. The dye image of Example 10 faded 50% in one week. The dye image of Example 13 faded 10% in three weeks. The dye image of Example 14 faded 10% in one week.

EXAMPLES 15-26

This illustrates use of ureidoaniline silver halide developing agents with a naphtholic dye-forming coupler in a photographic material.

The procedure described in Example 1 is repeated with the exceptions that (1) the dye-forming coupler in Example 1 was replaced by the following dye-forming coupler:

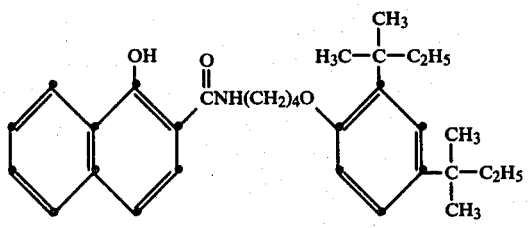

and (2) the ureidoaniline silver halide developing agents listed in following Table IIA replaced the ureidoaniline silver halide developing agents of Examples 1–14.

TABLE IIA

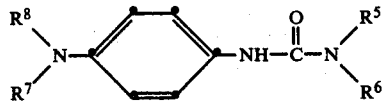

(Ureidoaniline)

| Example No. | $R^5$ | $R^6$ | $R^7$ and $R^8$ | $D_{max}$ (to red light) (dye image only) |
|---|---|---|---|---|
| 15 | $-CH(CH_3)_2$ | $-CH(CH_3)_2$ | $-C_2H_5$ | ≦0.2 |
| 16 | 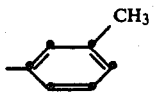 | H | $-C_2H_5$ | 0.56 |
| 17 | $-(CH_2)_2OH$ | H | $-C_2H_5$ | 0.9 |
| 18 | $-(CH_2)_3OH$ | H | $-C_2H_5$ | 0.9 |
| 19 | $-CH(CH_2OH)-CH_3$ | H | $-C_2H_5$ | 0.63 |
| 20 | n-butyl | H | $-C_2H_5$ | 0.78 |
| 21 | n-hexyl | H | $-C_2H_4$ | 0.90 |
| 22 | n-octyl | H | $-C_2H_5$ | 0.90 |
| 23 | n-dodecyl | H | $-C_2H_5$ | 1.15 |
| 24 | cyclohexyl | H | $-C_2H_5$ | 1.03 |
| 25 | t-butyl | H | $-C_2H_5$ | 1.46 |
| 26 | $-CH_2-C(=O)-OC_4H_9$ | H | $-C_2H_5$ | 1.1 |

EXAMPLE 27

This illustrates use of a dye image to enhance a silver image in a photographic element according to the invention.

The procedure described in Example 14 was repeated. A dye and silver image was produced. The maximum and minimum density observed by red light and the contrast of the images were as follows:

| | $D_{max}$ | $D_{min}$ | Contrast* |
|---|---|---|---|
| Ag image only | 1.22 | 0.06 | 0.7 |
| Ag image plus dye image | 2.96 | 0.12 | 4.0 |

*Contrast herein is measured for the straight-line portion if the sensitometric curve.

This demonstrates that the dye image significantly enhances the silver image and significantly increases contrast.

EXAMPLE 28

This further illustrates use of a dye image to enhance a silver image in a photographic element according to the invention. The procedure described in Example 25 was repeated. A dye and silver image was produced. The maximum and minimum density observed by red light and the contrast of the images were as follows:

| | $D_{max}$ | $D_{min}$ | Contrast |
|---|---|---|---|
| Ag image only | 0.82 | 0.09 | 0.5 |
| Ag image plus dye image | 2.26 | 0.10 | 6.0 |

This demonstrates that the dye image significantly enhances the silver image and significantly increases contrast.

EXAMPLES 29–35

The procedure described in Example 1 was repeated with the exception that developing agent of Example 25:

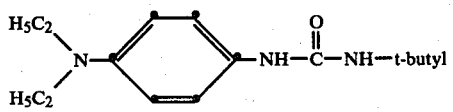

and the dye-forming couplers listed in the following Table IIIA respectively replaced the ureidoaniline silver halide developing agent and the dye-forming coupler of Example 1.

TABLE IIIA

| Example No. | Dye-Forming Coupler | $D_{max}$ (to red light) (dye only) |
|---|---|---|
| 29 | 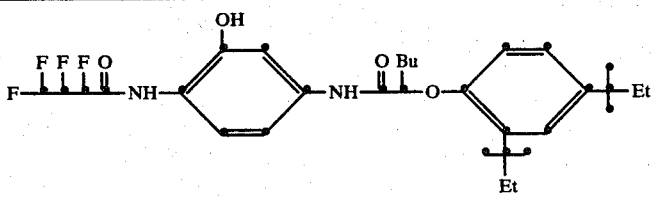 | 0.51 |

TABLE IIIA-continued
| Example No. | Dye-Forming Coupler | $D_{max}$ (dye only) |
|---|---|---|
| 30 | 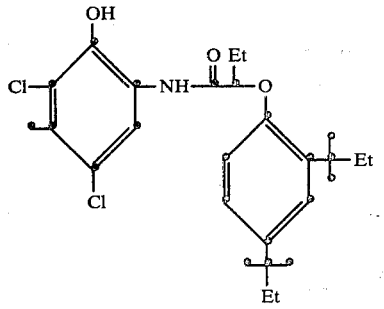 | 1.1 |
| 31 | 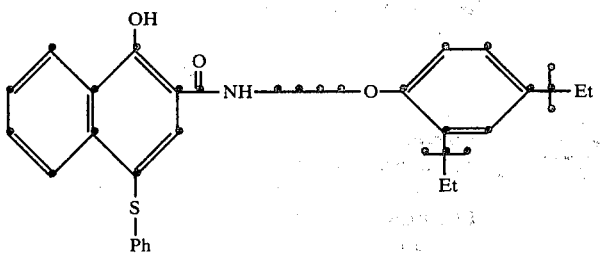 | 0.76 |
| 32 | 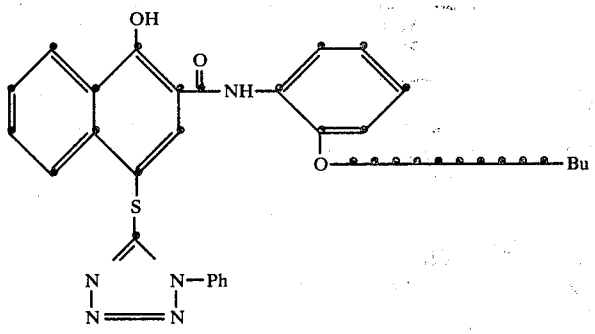 | 1.09 |
| 33 | 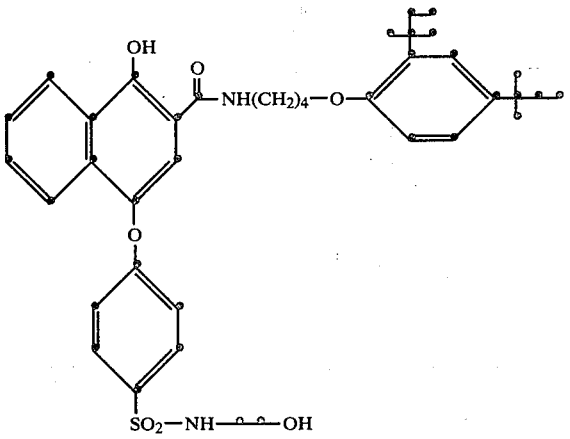 | 2.27 |

TABLE IIIA-continued

| | | |
|---|---|---|
| 34 | 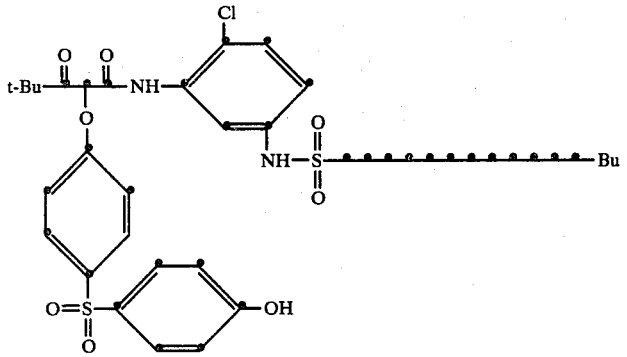 | 0.12 (to blue light) |
| 35 | 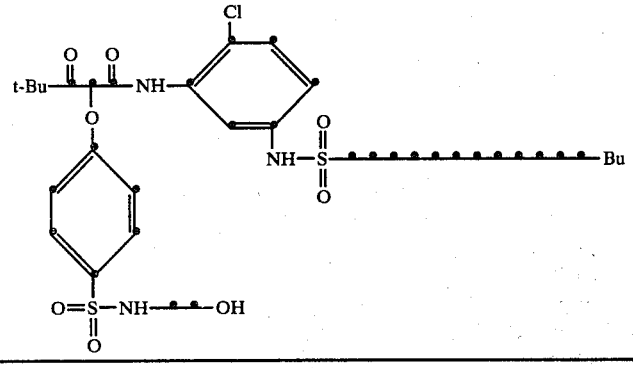 | 0.58 (to blue light) |

Cyan dye was formed with both the four equivalent coupler of Example 29 and the two equivalent coupler of Example 30. The coupler of Example 33 was preferred due to the maximum density of the dye image produced compared to the dye images produced with other couplers listed in Table IIIA.

EXAMPLE 36

The procedure described in Example 33 was repeated in which the ureidoaniline silver halide developing agent was the developing agent of Example 25:

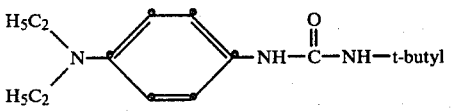

and the dye-forming coupler was the dye-forming coupler of Example 33:

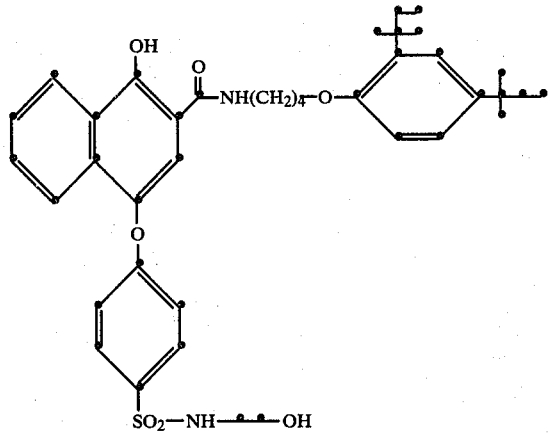

A silver image and dye image were produced. The maximum density, minimum density observed by red light and contrast of these images were as follows:

| | Dmax | Dmin | Contrast |
|---|---|---|---|
| Ag image only | 0.74 | 0.02 | 0.5 |
| Ag image plus dye image | 3.00 | 0.16 | 7.0 |

EXAMPLE 37

This illustrates formation of a magenta dye. The procedure described in Example 1 was repeated with the exception that the following ureidoaniline silver halide developing agent replaced the developing agent of Example 1:

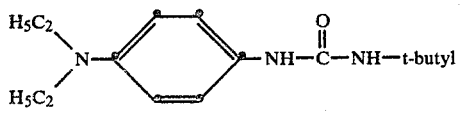

and the following dye-forming coupler replaced the dye-forming coupler of Example 1:

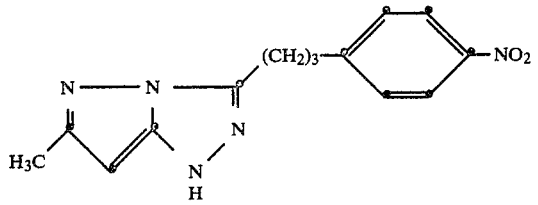

This combination of ureidoaniline silver halide developing agent and dye-forming coupler produced a magenta dye image upon oxidative coupling.

EXAMPLES 38–40

This illustrates use of a ureidoaniline silver halide developing agent in a silver halide developer solution.

A photographic silver halide element was prepared by coating on a poly(ethyleneterephthalate) film support a layer comprising (a) photographic silver chloride (150 mg/ft$^2$ as Ag corresponding to 1610 mg/M$^2$) spectrally sensitized to the red region of the electromagnetic spectrum by means of a spectral sensitizing dye, (b) a dye-forming coupler consisting of

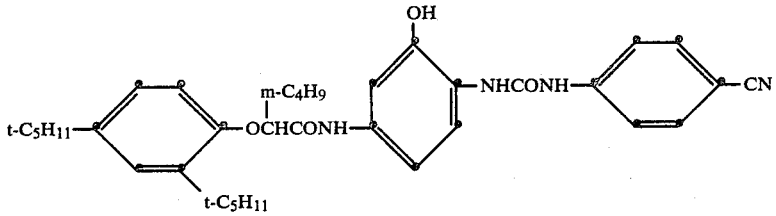

(55 mg/ft$^2$ corresponding to 590 mg/M$^2$) in a gelatin binder (350 mg/ft$^2$ corresponding to 3763 mg/M$^2$). The photographic element contained a gelatin overcoat (82 mg/ft$^2$ of gelatin corresponding to 880 mg/M$^2$). The photographic silver chloride element was imagewise exposed to light (2850° K. color temperature) by means of a commercial sensitometer for 1/50 second through a Wratten 29 filter (Wratten is a trademark), a 0.9 neutral density filter and a step tablet to produce a developable latent image in the element. The exposed photographic element was developed by immersing the element for 20 minutes at 38° C. in a silver halide developer solution containing:

| | |
|---|---|
| 1-(p-diethylaminophenyl)-3-hydroxyethylurea (ureidoaniline silver halide developing agent) | 1 g. |
| potassium carbonate (activator) | 2 g. |
| water to make (pH adjusted to 11.0 at room temperature (20° C.)) | 1 liter |

The developed photographic element was then immersed in an aqueous stop bath comprising 3% by weight acetic acid for one minute. The silver image developed and unreacted silver chloride were bleached in a bleach solution and fixed in a fixing solution to reveal a cyan dye image.

Very faint dye images were produced by repeating the procedure with the exception that the 1-(p-diethylaminophenyl)-3-hydroxyethylurea was replaced respectively by 0.7 g/liter of Example 39

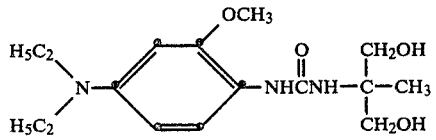

and 1.06 g/liter of Example 40

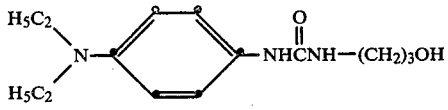

Examples A–K are comparative examples.

EXAMPLE A

The procedure described in Example 15 was repeated with the exception that the ureidoaniline silver halide developing agent in Example 15 was replaced by the following ureidoaniline compound:

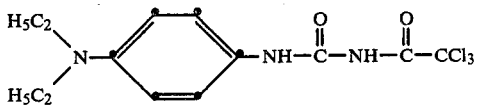

No dye image was observed in the processed photothermographic element. This indicates that strong electron withdrawing groups, such as

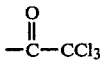

on the ureido moiety adversely affect dye formation.

EXAMPLES B–J

The procedure described in Example 1 was repeated with the exception that the developer of Example 25:

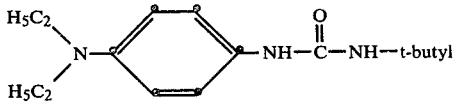

and the dye-forming couplers listed in the following Table IVA respectively replaced the ureidoaniline silver halide developing agent and the dye-forming coupler of Example 1. None of the photothermographic elements formed a dye image observable by the light noted in Table IVA.

No attempt was made to change or optimize the concentrations of components and processing conditions to produce a dye image observable by red or green light in these examples.

TABLE IVA

| Example No. | Dye-Forming Coupler | Dmax |
|---|---|---|
| B | 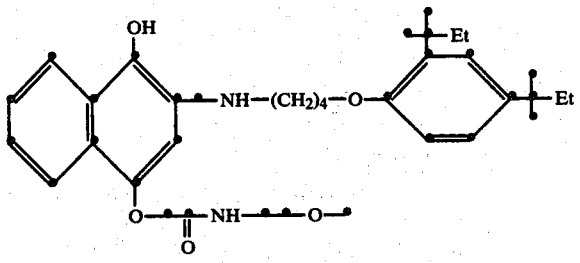 | 0 (to red light) |
| C | 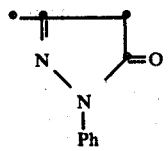 | 0 (to green light) |
| D | 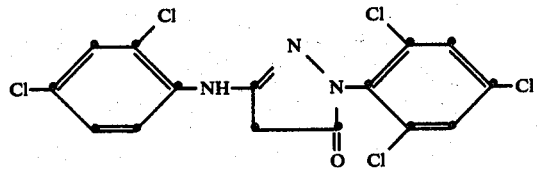 | 0 (to green light) |
| E | 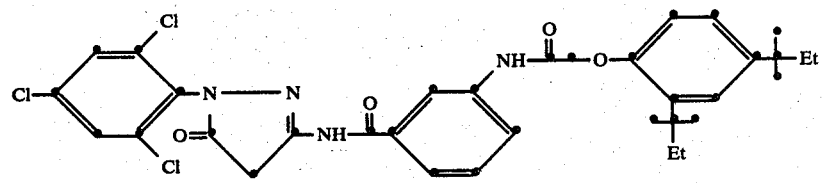 | 0 (to green light) |
| F | 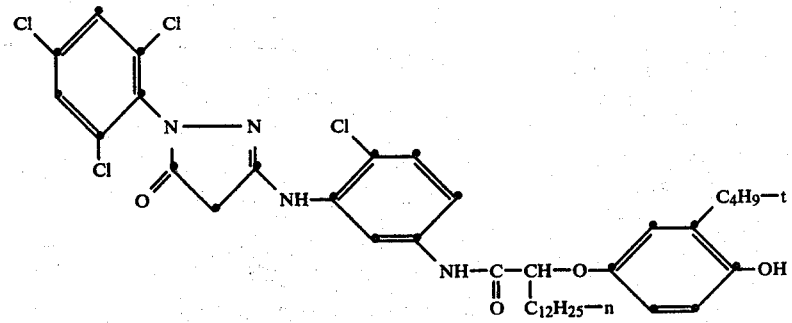 | 0 (to green light) |

TABLE IVA-continued

| Example No. | Dye-Forming Coupler | Dmax |
|---|---|---|
| G | 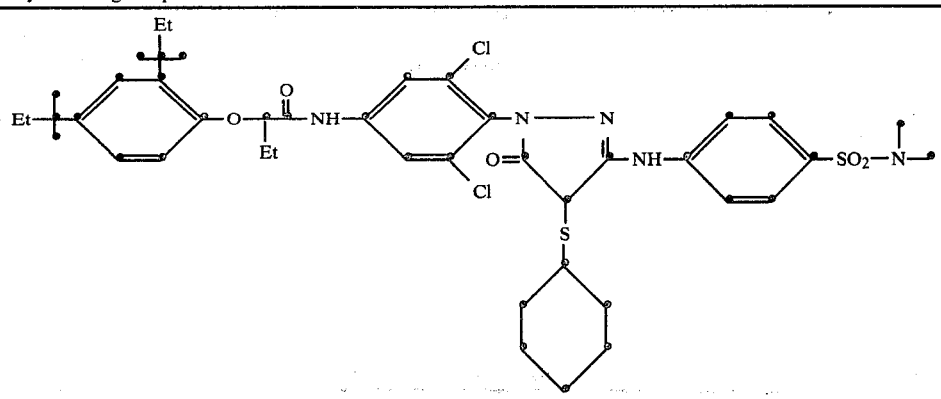 | 0 (to green light) |
| H | 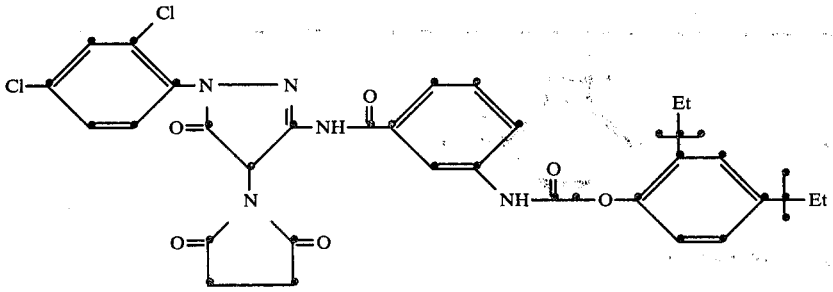 | 0 (to green light) |
| I | 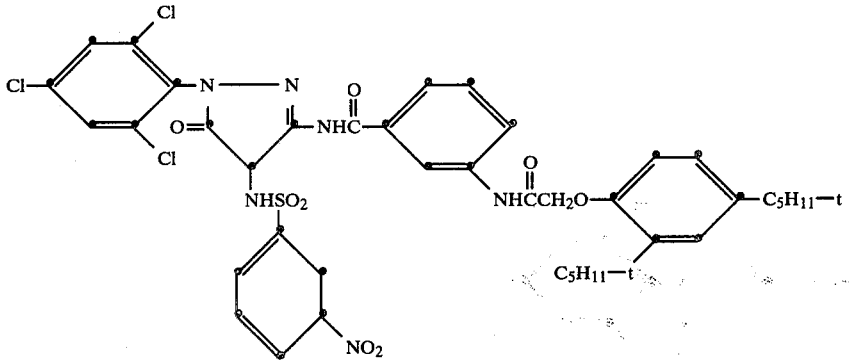 | 0 (to green light) |
| J | 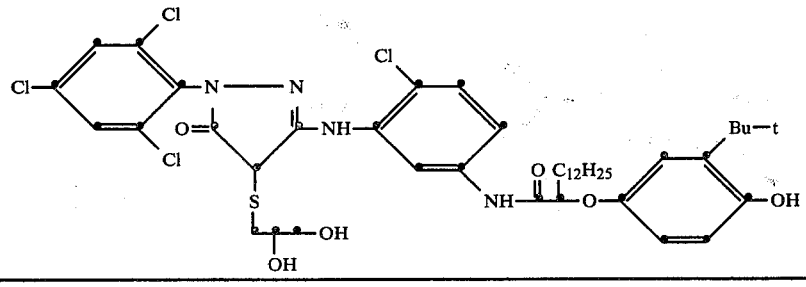 | 0 (to green light) |

• in the formulas herein means a carbon atom with any free bonds being satisfied by hydrogen atoms.
Ph in the formulas herein means phenyl.
Bu in the formulas herein means butyl.
Et in the formulas herein means ethyl.

EXAMPLE K

A photothermographic element was prepared by mixing and coating the following composition at a 101.6 micron (4 mil) wet coating thickness on a poly(ethyleneterephthalate) film support:

In 0.2 g of 2-methoxyethanol with 0.1 g tetrahydrofuran and 0.4 g of toluene were dissolved

| | |
|---|---|
| dye-forming coupler of Example 33 | 28 mg |
| phthalazinone (toner) | 2 mg |

-continued

| | |
|---|---|
| $HgCl_2$ | 0.125 mg |
| 1-(p-diethylaminophenyl)-3-t-butylurea (developing agent) | 11 mg |

0.14 g of 7 weight percent poly(vinylbutyral) (binder) (Butvar B-76 which is a trademark of and available from the Monsanto Co., U.S.A.) in toluene were added to the resulting composition with 0.6 g of silver behenate dispersion from Example 1 and 0.2 g of the silver bromoiodide emulsion from Example 1. The resulting photothermographic material was permitted to dry for five minutes at 54° C.

The photothermographic element was then imagewise exposed to light by means of a commercial sensitometer through a step tablet to produce a developable latent image in the element. The exposed photothermographic element was heated for 15 seconds at 120° C. on a heated metal block. This produced a silver image and dye image. The maximum density of the dye image (observed by red light) was 1.87. The minimum density of the dye image was 0.06.

The procedure was repeated with the exception that (1) the ureidoaniline silver halide developing agent was replaced by 7 mg. of a para-phenylenediamine silver halide developing agent consisting of

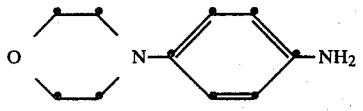

(2) the phthalazinone was omitted and (3) the exposed element was heated for ten seconds. This provided a purple dye image having a maximum density (observed by green light) of 0.85 and a minimum density of 0.12. The reason for omitting phthalazinone was that otherwise fog would have been excessive. The dye density of the image was significantly lower than the dye density of the image produced in the photothermographic element containing the ureidoaniline silver halide developing agent.

The invention has been described in detail with particular reference to preferred embodiments thereof, but it will be understood that variations and modifications can be effected within the spirit and scope of the invention.

What is claimed is:

1. In a dye-forming imaging element comprising a support bearing, in reactive association, (a) a dye-forming coupler, and (b) an organic reducing agent that is capable in its oxidized form of reacting with the dye-forming coupler to form a dye, the improvement wherein said reducing agent is a ureidoaniline silver halide developing agent free of strong electron withdrawing groups.

2. A dye-forming imaging element as in claim 1 wherein said ureidoaniline reducing agent is represented by the formula:

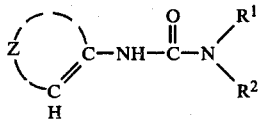

wherein

Z is the atoms necessary to complete an aniline silver halide developing agent;

$R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 or 6 member nonaromatic heterocyclic group; and, $R^2$ is hydrogen, alkyl containing 1 to 25 carbon atoms, aryl containing 6 to 25 carbon atoms, or with $R^1$ is the atoms selected from the group consisting of carbon, nitrogen and oxygen atoms necessary to complete a 5 or 6 member nonaromatic heterocyclic group.

3. A dye-forming imaging element as in claim 2 wherein $R^1$ is

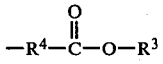

$R^3$ is alkyl containing 1 to 25 carbon atoms or aryl containing 6 to 25 carbon atoms; and, $R^4$ is alkylene containing 1 to 25 carbon atoms or arylene containing 6 to 25 carbon atoms.

4. A dye-forming imaging element as in claim 1 wherein said ureidoaniline silver halide developing agent is represented by the formula:

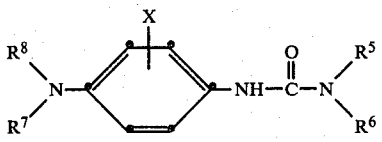

wherein $R^5$ is alkyl containing 1 to 25 carbon atoms, aryl containing 6 to 25 carbon atoms, or with $R^6$ is the atoms selected from the group consisting of carbon, nitrogen and oxygen atoms necessary to complete a 5 or 6 member nonaromatic heterocyclic group;

$R^6$ is hydrogen, alkyl containing 1 to 25 carbon atoms, or aryl containing 6 to 25 carbon atoms or with $R^5$ is the atoms selected from the group consisting of carbon, nitrogen and oxygen atoms necessary to complete a 5 or 6 member nonaromatic heterocyclic group;

$R^7$ is alkyl containing 1 to 25 carbon atoms or with $R^8$ is the atoms selected from the group consisting of carbon, nitrogen and oxygen atoms, necessary to complete a 5 or 6 member nonaromatic heterocyclic group;

$R^8$ is alkyl containing 1 to 25 carbon atoms, aryl containing 6 to 25 carbon atoms, or with $R^5$ is the atoms selected from the group consisting of carbon, nitrogen and oxygen atoms necessary to complete a 5 or 6 member nonaromatic heterocyclic group; and, X is hydrogen, alkyl containing 1 to 3 carbon atoms, alkoxy containing 1 to 3 carbon atoms, bromine, chlorine or iodine.

5. A dye-forming imaging element as in claim 4 wherein $R^5$ is

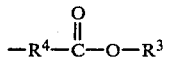

wherein $R^3$ is alkyl containing 1 to 25 carbon atoms or aryl containing 6 to 25 carbon atoms; and $R^4$ is alkylene containing 1 to 25 carbon atoms or arylene containing 6 to 25 carbon atoms or arylene containing 6 to 25 carbon atoms.

6. A dye-forming imaging element as in claim 1 wherein said ureidoaniline silver halide developing agent consists essentially of 1-(p-diethylaminophenyl)-3-t-butylurea.

7. A dye-forming imaging element as in claim 1 wherein said dye-forming coupler comprises a compound represented by the formula:

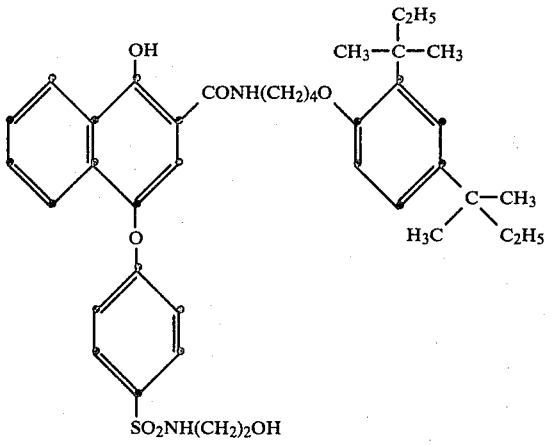

8. A dye-forming imaging element as in claim 1 also comprising photographic silver halide.

9. In a photothermographic element comprising a support having thereon, in reactive association:

(a) photographic silver halide, (b) a dye-forming coupler, and (c) an oxidation-reduction image forming combination comprising (1) an organic silver salt oxidizing agent, and (2) an organic reducing agent for said organic silver salt oxidizing agent, the improvement wherein said reducing agent is a ureidoaniline reducing agent that is capable in its oxidized form of reacting with said dye-forming coupler to form a dye.

10. A photothermographic element as in claim 9 wherein said ureidoaniline reducing agent is represented by the formula:

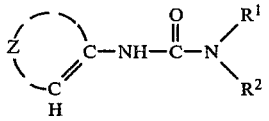

wherein

Z is the atoms necessary to complete an aniline silver halide developing agent;

$R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 or 6 member nonaromatic heterocyclic group; and, $R^2$ is hydrogen, alkyl containing 1 to 25 carbon atoms, aryl containing 6 to 25 carbon atoms, or with $R^1$ is the atoms selected from the group consisting of carbon, nitrogen and oxygen atoms necessary to complete a 5 or 6 member nonaromatic heterocyclic group.

11. A photothermographic element as in claim 10 wherein $R^1$ is

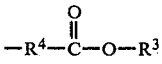

wherein $R^3$ is alkyl containing 1 to 25 carbon atoms or aryl containing 6 to 25 carbon atoms; and, $R^4$ is alkylene containing 1 to 25 carbon atoms or arylene containing 6 to 25 carbon atoms.

12. A photothermographic element as in claim 10 wherein said ureidoaniline reducing agent is represented by the formula:

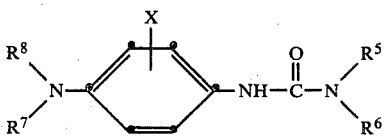

wherein $R^5$ is alkyl containing 1 to 25 carbon atoms, aryl containing 6 to 25 carbon atoms, or with $R^6$ is the atoms selected from the group consisting of carbon, nitrogen and oxygen atoms necessary to complete a 5 to 6 member nonaromatic heterocyclic group;

$R^6$ is hydrogen, alkyl containing 1 to 25 carbon atoms, or aryl containing 6 to 25 carbon atoms or with $R^5$ is the atoms selected from the group consisting of carbon, nitrogen and oxygen atoms necessary to complete a 5 or 6 member heterocyclic group;

$R^7$ is alkyl containing 1 to 25 carbon atoms, or with $R^8$ is the atoms selected from the group consisting of carbon, nitrogen and oxygen atoms, necessary to complete a 5 or 6 member nonaromatic heterocyclic group;

$R^8$ is alkyl containing 1 to 25 carbon atoms or with $R^7$ is the atoms selected from the group consisting of carbon, hydrogen, nitrogen and oxygen atoms necessary to complete a 5 or 6 member nonaromatic heterocyclic group; and, X is hydrogen, alkyl containing 1 to 3 carbon atoms, alkoxy containing 1 to 3 carbon atoms, bromine, chlorine or iodine.

13. A photothermographic element as in claim 12 wherein $R^1$ is

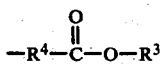

wherein $R^3$ is alkyl containing 1 to 25 carbon atoms or aryl containing 6 to 25 carbon atoms; and, $R^4$ is alkylene containing 1 to 25 carbon atoms or arylene containing 6 to 25 carbon atoms.

14. A photothermographic element as in claim 9 wherein said ureidoaniline reducing agent consists essentially of 1-(p-diethylaminophenyl)-3-t-butylurea.

15. A photothermographic element as in claim 9 also comprising a toning agent.

16. A photothermographic element as in claim 9 also comprising a toning agent selected from the group consisting of phthalazinone, phthalimide, N-hydroxynaphthalimide, phthalazine and succinimide toning agents and combinations thereof.

17. A photothermographic element as in claim 9 also comprising a binder.

18. A photothermographic element as in claim 9 also comprising a poly(vinyl butyral) binder.

19. In a photothermographic element comprising a support having thereon, in reactive association, in a poly(vinylbutyral) binder:

(a) photographic silver halide, (b) a dye-forming coupler, and (c) an oxidation-reduction image forming combination comprising (1) an organic silver salt oxidizing agent comprising silver behenate, and (2) an organic reducing agent for said organic silver salt oxidizing agent, the improvement wherein said reducing agent is a ureidoaniline reducing agent that consists essentially of 1-(p-diethylaminophenyl)-3-t-butylurea.

20. A photothermographic element as in claim 19 wherein said dye-forming coupler comprises a compound represented by the formula:

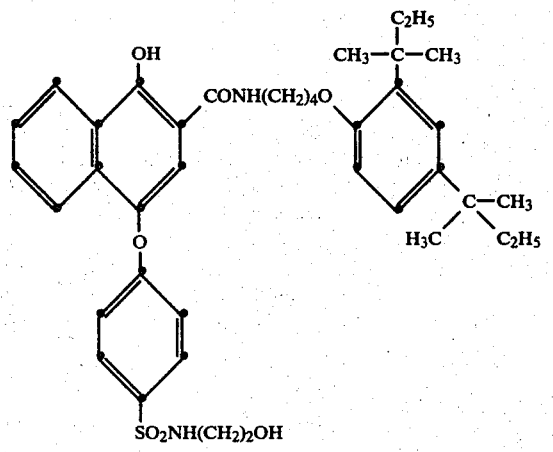

21. In a dye-forming imaging composition comprising (a) a dye-forming coupler, and (b) an organic reducing agent that is capable in its oxidized form of reacting with the dye-forming coupler to form a dye, the improvement wherein said reducing agent is a ureidoaniline silver halide developing agent free of strong electron withdrawing groups.

22. A dye-forming imaging composition as in claim 21 wherein said ureidoaniline silver halide developing agent is represented by the formula:

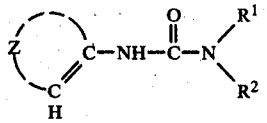

wherein

Z is the atoms necessary to complete an aniline silver halide developing agent;

$R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 or 6 member nonaromatic heterocyclic group; and, $R^2$ is hydrogen, alkyl containing 1 to 25 carbon atoms, aryl containing 6 to 25 carbon atoms, or with $R^1$ is the atoms selected from the group consisting of carbon, nitrogen and oxygen atoms necessary to complete a 5 or 6 member nonaromatic heterocyclic group.

23. A dye-forming imaging composition as in claim 22 wherein $R^1$ is

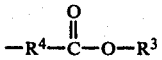

wherein $R^3$ is alkyl containing 1 to 25 carbon atoms or aryl containing 6 to 25 carbon atoms; and, $R^4$ is alkylene containing 1 to 25 carbon atoms or arylene containing 6 to 25 carbon atoms.

24. A dye-forming imaging composition as in claim 21 wherein said ureidoaniline silver halide developing agent is represented by the formula:

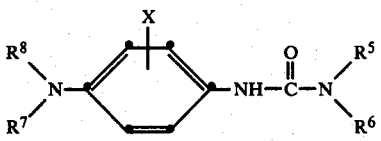

wherein $R^5$ is alkyl containing 1 to 25 carbon atoms, aryl containing 6 to 25 carbon atoms, or with $R^6$ is the atoms selected from the group consisting of carbon, nitrogen and oxygen atoms necessary to complete a 5 or 6 member nonaromatic heterocyclic group;

$R^6$ is hydrogen, alkyl containing 1 to 25 carbon atoms, or aryl containing 6 to 25 carbon atoms or with $R^5$ is the atoms selected from the group consisting of carbon, nitrogen and oxygen atoms necessary to complete a 5 or 6 member nonaromatic heterocyclic group;

$R^7$ is alkyl containing 1 to 25 carbon atoms or with $R^8$ is the atoms selected from the group consisting of carbon, nitrogen and oxygen atoms, necessary to complete a 5 or 6 member nonaromatic heterocyclic group;

$R^8$ is alkyl containing 1 to 25 carbon atoms aryl containing 6 to 25 carbon atoms, or with $R^7$ is the atoms selected from the group consisting of carbon, nitrogen and oxygen atoms necessary to complete a 5 or 6 member nonaromatic heterocyclic group; and, X is hydrogen, alkyl containing 1 to 3 carbon atoms, alkoxy containing 1 to 3 carbon atoms, bromine, chlorine or iodine.

25. A dye-forming imaging composition as in claim 24 wherein $R^5$ is

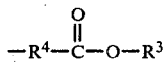

wherein $R^3$ is alkyl containing 1 to 25 carbon atoms or aryl containing 6 to 25 carbon atoms; and, $R^4$ is alkylene containing 1 to 25 carbon atoms or arylene containing 6 to 25 carbon atoms.

26. A dye-forming imaging composition as in claim 21 wherein said ureidoaniline silver halide developing agent consists essentially of 1-(p-diethylaminophenyl)-3-t-butylurea.

27. A dye-forming imaging composition as in claim 21 also comprising a binder.

28. A dye-forming imaging composition as in claim 21 wherein said dye-forming coupler comprises a compound represented by the formula:

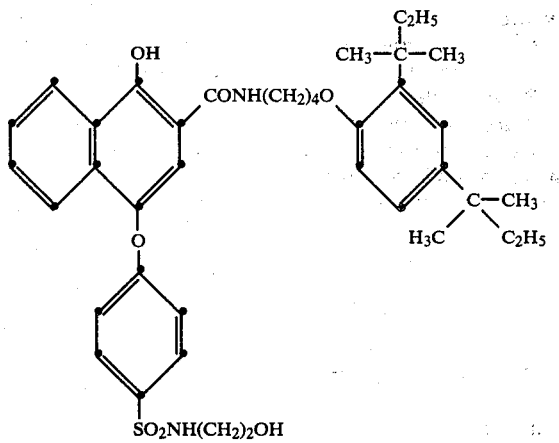

29. In a photothermographic composition comprising:

(a) photographic silver halide, (b) a dye-forming coupler, and (c) an oxidation-reduction image forming combination comprising (1) an organic silver salt oxidizing agent, and (2) an organic reducing agent for said organic silver salt oxidizing agent, the improvement wherein said reducing agent is a ureidoaniline reducing agent that is capable in its oxidized form of reacting with said dye-forming coupler to form a dye.

30. A photothermographic composition as in claim 29 wherein said ureidoaniline reducing agent is represented by the formula:

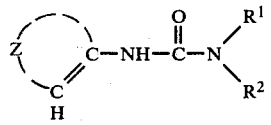

wherein

Z is the atoms necessary to complete an aniline silver halide developing agent;

$R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 or 6 member nonaromatic heterocyclic group; and, $R^2$ is hydrogen, alkyl containing 1 to 25 carbon atoms, aryl containing 6 to 25 carbon atoms, or with $R^1$ is the atoms selected from the group consisting of carbon, nitrogen and oxygen atoms necessary to complete a 5 or 6 member nonaromatic heterocyclic group.

31. A photothermographic composition as in claim 30 wherein $R^1$ is

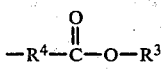

wherein $R^3$ is alkyl containing 1 to 25 carbon atoms or aryl containing 6 to 25 carbon atoms; and, $R^4$ is alkylene containing 1 to 25 carbon atoms or arylene containing 6 to 25 carbon atoms.

32. A photothermographic composition as in claim 29 wherein said ureidoaniline reducing agent is represented by the formula:

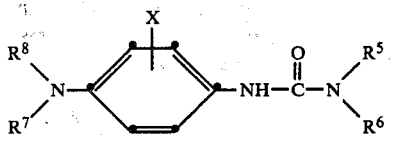

wherein $R^5$ is alkyl containing 1 to 25 carbon atoms, aryl containing 6 to 25 carbon atoms, or with $R^6$ is the atoms selected from the group consisting of carbon, nitrogen and oxygen atoms necessary to complete a 5 to 6 member nonaromatic heterocyclic group;

$R^6$ is hydrogen, alkyl containing 1 to 25 carbon atoms, or aryl containing 6 to 25 carbon atoms or with $R^5$ is the atoms selected from the group consisting of carbon, nitrogen and oxygen atoms necessary to complete a 5 or 6 member nonaromatic heterocyclic group;

$R^7$ is alkyl containing 1 to 25 carbon atoms or with $R^8$ is the atoms selected from the group consisting of carbon, nitrogen and oxygen atoms, necessary to complete a 5 or 6 member nonaromatic heterocyclic group;

$R^8$ is alkyl containing 1 to 25 carbon atoms or with $R^7$ is the atoms selected from the group consisting of carbon, nitrogen and oxygen atoms necessary to complete a 5 or 6 member nonaromatic heterocyclic group; and, X is hydrogen, alkyl containing 1 to 3 carbon atoms, alkoxy containing 1 to 3 carbon atoms, bromine, chlorine or iodine.

33. A photothermographic composition as in claim 29 wherein said ureidoaniline reducing agent consists essentially of 1-(p-diethyaminophenyl)-3-t-butylurea.

34. A photothermographic composition as in claim 29 also comprising a toning agent.

35. A photothermographic composition as in claim 29 also comprising a toning agent selected from the group consisting of phthalazinone, phthalimide, N-hydroxynaphthalimide, phthalazine and succinimide toning agents and combinations thereof.

36. A photothermographic composition as in claim 29 also comprising a binder.

37. A photothermographic composition as in claim 29 also comprising a poly(vinyl butyral) binder.

38. In a photothermographic composition comprising, in a poly(vinyl butyral) binder:

(a) photographic silver halide, (b) a dye-forming coupler, and (c) an oxidation-reduction image forming combination comprising (1) an organic silver salt oxidizing agent comprising silver behenate, and (2) an organic reducing agent for said organic silver salt oxidizing agent, the improvement wherein said reducing agent is a ureidoaniline reducing agent that consists essentially of 1-(p-diethylaminophenyl)-3-t-butylurea.

39. A photothermographic composition as in claim 38 wherein said dye-forming coupler comprises a compound represented by the formula:

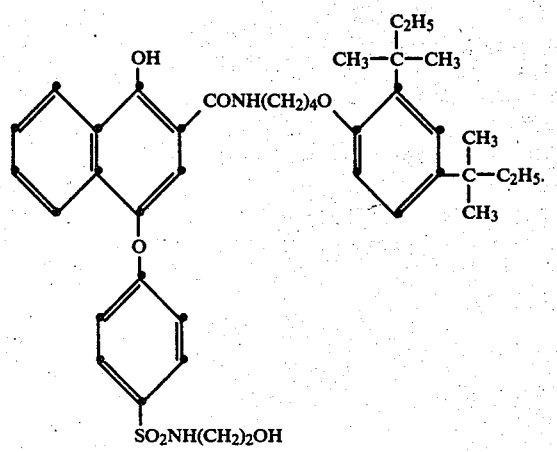

40. A process of producing a dye image in an exposed photothermographic element as defined in claim 9 comprising heating said element to a temperature within the range of about 90° C. to about 200° C. until said dye image is produced.

41. A process of producing a dye image in an exposed photothermographic element as defined in claim 19 comprising heating said element to a temperature within the range of about 90° C. to about 200° C. until said dye image is produced.

42. A thermographic element comprising a support having thereon, in reactive association, in binder:

(a) a dye-forming coupler, and (b) an oxidation-reduction image forming combination comprising (1) an organic silver salt oxidizing agent, and (2) an organic reducing agent for said organic silver salt oxidizing agent, the improvement wherein said reducing agent is a ureidoaniline reducing agent that is capable in its oxidized form of reacting with said dye-forming coupler to form a dye.

43. A thermographic element as in claim 42 wherein said ureidoaniline reducing agent is represented by the formula:

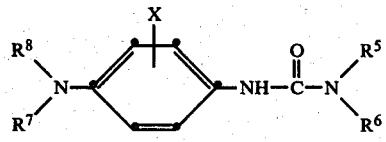

wherein $R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 to 6 member heterocyclic group;

$R^2$ is hydrogen, alkyl containing 1 to 25 carbon atoms, or aryl containing 6 to 25 carbon atoms or with $R^1$ is the atoms selected from the group consisting of carbon, nitrogen and oxygen atoms necessary to complete a 5 or 6 member nonaromatic heterocyclic group;

$R^5$ is aryl containing 6 to 25 carbon atoms, alkyl containing 1 to 25 carbon atoms, or with $R^6$ is the atoms selected from the group consisting of carbon, nitrogen and oxygen atoms, necessary to complete a 5 or 6 member nonaromatic heterocyclic group;

$R^6$ is hydrogen, alkyl containing 1 to 25 carbon atoms, aryl containing 6 to 25 carbon atoms, or with $R^5$ is the atoms selected from the group consisting of carbon, nitrogen and oxygen atoms necessary to complete a 5 or 6 member nonaromatic heterocyclic group; and, X is hydrogen, alkyl containing 1 to 3 carbon atoms, alkoxy containing 1 to 3 carbon atoms, bromine, chlorine or iodine.

44. A thermographic element as in claim 42 wherein said ureidoaniline reducing agent comprises 1-(p-diethylaminophenyl)-3-t-butylurea.

45. A thermographic element as in claim 42 also comprising a toning agent.

46. A thermographic element as in claim 42 comprising a toning agent selected from the group consisting of phthalazinone, phthalimide, N-hydroxynaphthalimide, phthalazine and succinimide toning agents and combinations thereof.

47. A thermographic element comprising a support having thereon, in reactive association, in a poly(vinyl butyral) binder:

(a) an oxidation-reduction image forming combination comprising (1) an organic silver salt oxidizing agent comprising silver behenate, and (2) an organic reducing agent for said organic silver salt oxidizing agent comprising a ureidoaniline reducing agent that consists essentially of 1-(p-diethylaminophenyl)-3-t-butylurea; and, (b) a dye-forming coupler.

48. A process of producing an image in a thermographic element as defined in claim 42 comprising imagewise heating said element to a temperature within the range of about 90° C. to about 200° C. until said image is produced.

49. A process of producing an image in a thermographic element as defined in claim 47 comprising imagewise heating said element to a temperature within the range of about 90° C. to about 200° C. until said image is produced.

50. In a dye-forming processing solution for a photographic silver halide element, said solution comprising (a) a dye-forming coupler, (b) a silver halide developing agent that is capable in its oxidized form of reacting with the dye-forming coupler to form a dye, (c) an alkaline activator, and (d) at least one solvent, the improvement wherein said silver halide developing agent is a ureidoaniline silver halide developing agent.

51. A dye-forming processing solution as in claim 50 wherein said ureidoaniline silver halide developing agent is represented by the formula:

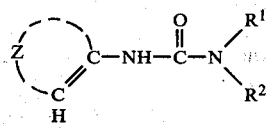

wherein

Z is the atoms necessary to complete an aniline silver halide developing agent;

$R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 or 6 member heterocyclic group; and, $R^2$ is hydrogen, alkyl containing 1 to 25 carbon atoms, aryl containing 6 to 25 carbon atoms, or with $R^1$ is the atoms selected from the group consisting of carbon, nitrogen and oxygen atoms necessary to complete a 5 or 6 member nonaromatic heterocyclic group.

52. A dye-forming processing solution as in claim 51 wherein $R^1$ is

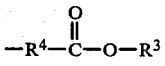

wherein $R^3$ is alkyl containing 1 to 25 carabon atoms or aryl containing 6 to 25 carbon atoms; and, $R^4$ is alkylene containing 1 to 25 carbon atoms or arylene containing 6 to 25 carbon atoms.

53. A dye-forming processing solution as in claim 50 wherein said ureidoaniline silver halide developing agent is represented by the formula:

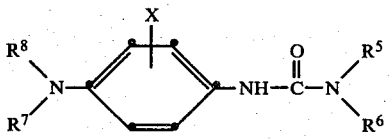

wherein $R^5$ is alkyl containing 1 to 25 carbon atoms, aryl containing 6 to 25 carbon atoms, or with $R^6$ is the atoms selected from the group consisting of carbon, nitrogen and oxygen atoms necessary to complete a 5 to 6 member nonaromatic heterocyclic group;

$R^6$ is hydrogen, alkyl containing 1 to 25 carbon atoms, or aryl containing 6 to 25 carbon atoms or with $R^1$ is the atoms selected from the group consisting of carbon, nitrogen and oxygen atoms necessary to complete a 5 or 6 member nonaromatic heterocyclic group;

$R^7$ is alkyl containing 1 to 25 carbon atoms or with $R^8$ is the atoms selected from the group consisting of carbon, nitrogen and oxygen atoms, necessary to complete a 5 or 6 member nonaromatic heterocyclic group;

$R^8$ is alkyl containing 1 to 25 carbon atoms or with $R^7$ is the atoms selected from the group conisting of carbon, nitrogen and oxygen atoms necessary to complete a 5 or 6 member nonaromatic heterocyclic group; and, X is hydrogen, alkyl containing 1 to 3 carbon atoms, alkoxy containing 1 to 3 carbon atoms, bromine, chlorine or iodine.

54. In a method of forming a dye image in an exposed photographic element comprising a support bearing, in reactive association;

(a) photographic silver halide, and (b) a dye-forming coupler, comprising developing the exposed photographic element in a silver halide developer solution, the improvement comprising, developing said exposed photographic element in a developer solution comprising an alkaline activator and a ureidoaniline silver halide developing agent which reacts in its oxidized form with the dye-forming coupler to form a dye.

55. A method of forming a dye image as in claim 54 also comprising bleaching and fixing the resulting image.

56. A method of forming a dye image as in claim 54 wherein said ureidoaniline silver halide developing agent is represented by the formula:

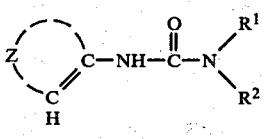

wherein

Z is the atoms necessary to complete an aniline silver halide developing agent, $R^1$ is alkyl containing 1 to 25 carbon atoms, aryl containing 6 to 25 carbon atoms, or with $R^2$ is the atoms selected from the group consisting of carbon, nitrogen and oxygen atoms necessary to complete a 5 or 6 member nonaromatic heterocyclic group; and, $R^2$ is hydrogen, alkyl containing 1 to 25 carbon atoms, aryl containing 6 to 25 carbon atoms, or with $R^1$ is the atoms selected from the group consisting of carbon, nitrogen and oxygen atoms necessary to complete a 5 or 6 member nonaromatic heterocyclic group.

57. A method of forming a dye image as in claim 54 wherein said ureidoaniline silver halide developing agent is represented by the formula:

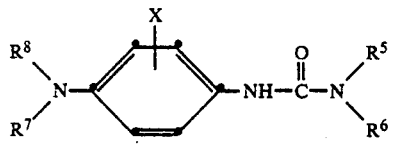

wherein $R^5$ is alkyl containing 1 to 25 carbon atoms, aryl containing 6 to 25 carbon atoms, or with $R^6$ is the atoms selected from the group consisting of carbon, nitrogen and oxygen atoms necessary to complete a 5 to 6 member nonaromatic heterocyclic group;

$R^6$ is hydrogen, alkyl containing 1 to 25 carbon atoms, or aryl containing 6 to 25 carbon atoms or with $R^5$ is the atoms selected from the group consisting of carbon, nitrogen and oxygen atoms necessary to complete a 5 or 6 member nonaromatic heterocyclic group;

$R^7$ is alkyl containing 1 to 25 carbon atoms or with $R^8$ is the atoms selected from the group consisting of carbon, nitrogen and oxygen atoms, necessary to complete a 5 or 6 member nonaromatic heterocyclic group;

$R^8$ is alkyl containing 1 to 25 carbon atoms or with $R^7$ is the atoms selected from the group consisting of carbon, nitrogen and oxygen atoms necessary to complete a 5 or 6 member nonaromatic heterocyclic group;

X is hydrogen, alkyl containing 1 to 3 carbon atoms, alkoxy containing 1 to 3 carbon atoms, bromine, chlorine or iodine.

58. A method of forming a dye image as in claim 54 wherein said ureidoaniline silver halide developing agent consists essentially of 1-(p-diethylaminophenyl)-3-hydroxyethylurea.

* * * * *

UNITED STATES PATENT AND TRADEMARK OFFICE

CERTIFICATE OF CORRECTION

PATENT NO. 4,426,441

DATED January 17, 1984

INVENTOR(S) Anthony Adin and Roy C. DeSelms

It is certified that error appears in the above-identified patent and that said Letters Patent are hereby corrected as shown below:

Column 1, line 52, "water" should read --wider--.

Column 3, line 41, "pyrrlino" should read --pyrrolino--.

Column 4, line 41, "pyrrlidino" should read --pyrrolidino--; line 60, "$R^5$" should read --$R^7$--.

Column 5, structure (6) should read

-- 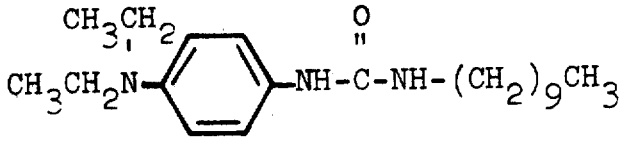 --.

Column 13, line 9, "$R^7$" should read --$R^{11}$--.

Column 14, line 56, "the" should read --The--.

UNITED STATES PATENT AND TRADEMARK OFFICE

CERTIFICATE OF CORRECTION

PATENT NO. 4,426,441

DATED January 17, 1984

INVENTOR(S) Anthony Adin and Roy C. DeSelms

It is certified that error appears in the above-identified patent and that said Letters Patent are hereby corrected as shown below:

Column 22, line 25, "siver" should read --silver--.

Column 23, line 11, before "by mixing" insert --(prepared--.

Column 39, lines 15-16, delete "or arylene containing 6 to 25 carbon atoms".

Column 45, line 6, "1-(p-diethyaminophenyl)-3-t-butylurea" should read --1-(p-diethylaminophenyl)-3-t-butylurea--.

Signed and Sealed this

*Nineteenth* Day of *June 1984*

[SEAL]

*Attest:*

GERALD J. MOSSINGHOFF

*Attesting Officer*

*Commissioner of Patents and Trademarks*